US006104362A

United States Patent [19]

Kuriyama et al.

[11] Patent Number: 6,104,362

[45] Date of Patent: Aug. 15, 2000

[54] PANEL DISPLAY IN WHICH THE NUMBER OF SUSTAINING DISCHARGE PULSES IS ADJUSTED ACCORDING TO THE QUANTITY OF DISPLAY DATA, AND A DRIVING METHOD FOR THE PANEL DISPLAY

[75] Inventors: Hirohito Kuriyama; Masaya Tajima; Toshio Ueda; Katsuhiro Ishida; Akira Yamamoto, all of Kawasaki, Japan

[73] Assignee: Fujitsu Limited, Kawasaki, Japan

[21] Appl. No.: 09/358,117

[22] Filed: Jul. 21, 1999

Related U.S. Application Data

[62] Division of application No. 08/641,894, May 2, 1996.

[30] Foreign Application Priority Data

Sep. 1, 1995 [JP] Japan ..... 7-225408
Dec. 28, 1995 [JP] Japan ..... 7-343953

[51] Int. Cl.[7] ..... G09G 3/28

[52] U.S. Cl. ..... 345/63; 345/60; 345/147; 345/148; 345/213

[58] Field of Search ..... 345/63, 214, 68, 345/89, 90, 98–100, 60, 147, 148, 213

[56] References Cited

U.S. PATENT DOCUMENTS 5,343,215 8/1994 Tanaka ..... 345/63
5,420,602 5/1995 Kanazawa ..... 345/67
5,541,618 7/1996 Shinoda ..... 345/60

FOREIGN PATENT DOCUMENTS 61-98389 5/1986 Japan .
6-348227 12/1994 Japan .
7-44127 2/1995 Japan .

*Primary Examiner*—Richard A. Hjerpe
*Assistant Examiner*—Henry N. Tran
*Attorney, Agent, or Firm*—Greer, Burns & Crain, Ltd.

[57] ABSTRACT

A panel display has a display panel including a plurality of cells to be selectively discharged to an address driver for setting the plurality of cells to states represented by display data. The panel display also has a display glowing driver for enabling the plurality of cells to glow according to the set states. One frame during which one screen is displayed has a plurality of sub-frames and glowing periods within the sub-frames, during which the display cells are enabled to glow by the display glowing driver. The said sub-frames are weighted in order to achieve gray-scale display. The display panel also has a display load calculating circuit for calculating a display load to be imposed on a whole display surface during each sub-frame. In addition, a corrected period calculating circuit calculates a corrected period of a glowing period, during which the display cells are enabled to glow by the display glowing driver according to display loads to be imposed during each sub-frame. This is calculated by the display load calculating circuit so that brightness attained by the display cells during respective sub-frames will be maintained at a given ratio.

14 Claims, 34 Drawing Sheets

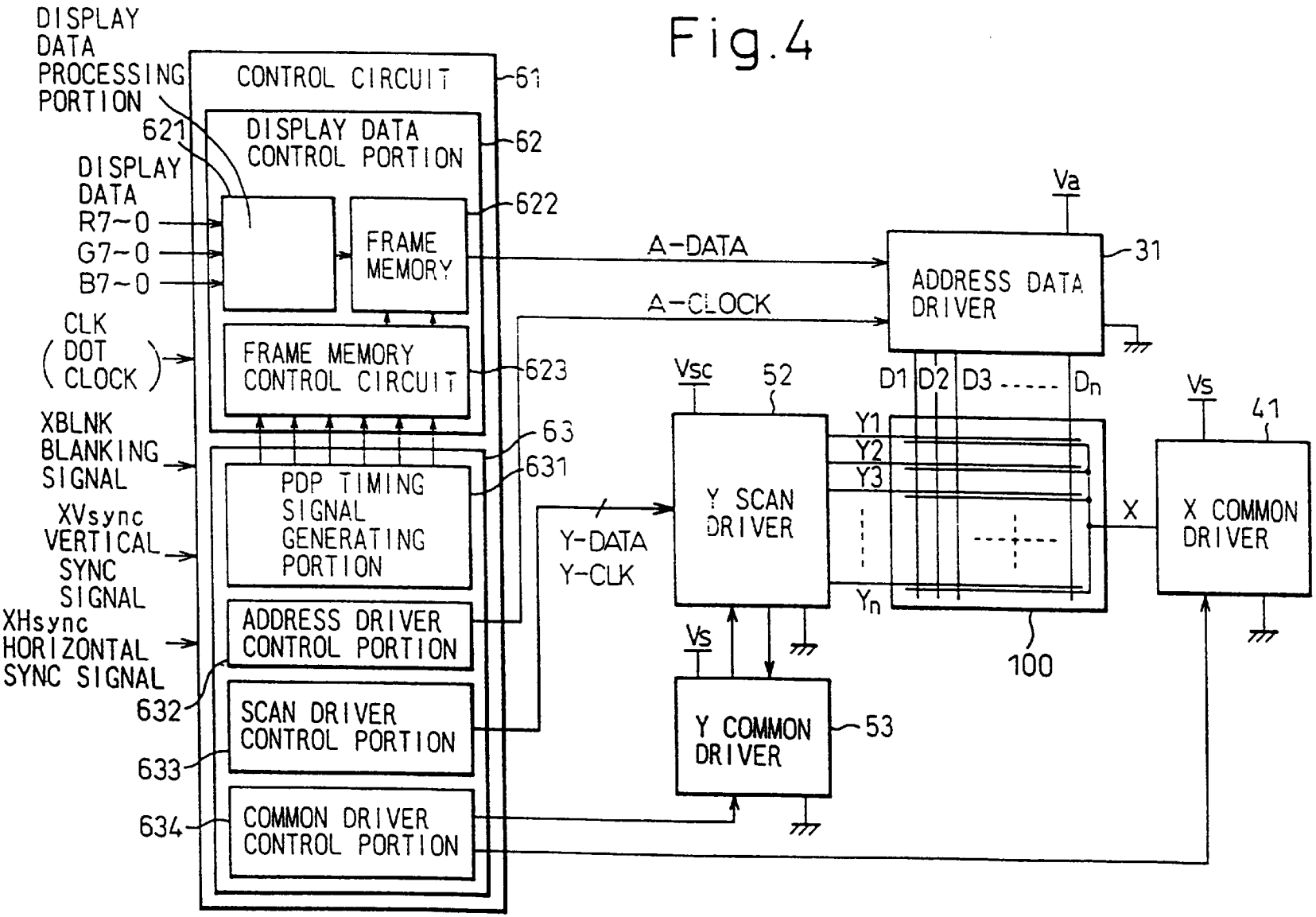
Fig.4
X COMMON DRIVER
41
Vs
X
ADDRESS DATA DRIVER
31
Va
Dn
D3
D2
D1
100
Y1
Y2
Y3
Yn
Y SCAN DRIVER
52
Vsc
Y COMMON DRIVER
53
Vs
A-DATA
A-CLOCK
Y-DATA
Y-CLK
CONTROL CIRCUIT
61
DISPLAY DATA CONTROL PORTION
62
FRAME MEMORY
622
FRAME MEMORY CONTROL CIRCUIT
623
63
631
PDP TIMING SIGNAL GENERATING PORTION
ADDRESS DRIVER CONTROL PORTION
632
SCAN DRIVER CONTROL PORTION
633
COMMON DRIVER CONTROL PORTION
634
621
DISPLAY DATA PROCESSING PORTION
DISPLAY DATA R7~0 G7~0 B7~0
CLK (DOT CLOCK)
XBLNK BLANKING SIGNAL
XVsync VERTICAL SYNC SIGNAL
XHsync HORIZONTAL SYNC SIGNAL

Fig.21

| ADDRESS | DATA |
|---|---|
| 00 | 16 (1×16) |
| 01 | 32 (2×16) |
| 02 | 64 (4×16) |
| 03 | 128 (8×16) |
| 04 | 256 (16×16) |
| 05 | 512 (32×16) |
| 06 | 1024 (64×16) |
| 07 | 2048 (128×16) |

Fig.26

ROM DATA

| ADDRESS | DATA | NOTES | |
|---|---|---|---|
| ＊＊00 | 10 | SF0 | LOAD 20% |
| ＊＊01 | 11 | SF0 | LOAD 40% |
| ＊＊02 | 12 | SF0 | LOAD 60% |
| ＊＊03 | 13 | SF0 | LOAD 80% |
| ＊＊04 | 14 | SF0 | LOAD 100% |
| ＊＊10 | 20 | SF1 | LOAD 20% |
| ＊＊11 | 22 | SF1 | LOAD 40% |
| ＊＊12 | 24 | SF1 | LOAD 60% |
| ＊＊13 | 28 | SF1 | LOAD 80% |
| ＊＊14 | 32 | SF1 | LOAD 100% |
| ⋮ | ⋮ | ⋮ | |
| ＊＊n0 | 80 | SFn | LOAD 20% |
| ＊＊n1 | 88 | SFn | LOAD 40% |
| ＊＊n2 | 96 | SFn | LOAD 60% |
| ＊＊n3 | 112 | SFn | LOAD 80% |
| ＊＊n4 | 128 | SFn | LOAD 100% |

EACH NUMBER OF PULSES IS DETERMINED SO THAT LUMINANCE OBTAINED BY THE CORRESPONDING DISPLAY LOAD MATCHES WITH THAT BY DISPLAY LOAD 100%.

Fig.30

ROM DATA

| ADDRESS | DATA | NOTES | |
|---|---|---|---|
| * 000 | 16 | SF0 LOAD 20% | MAXIMUM LOAD 20% |
| * 001 | — | SF0 LOAD 40% | MAXIMUM LOAD 20% |
| * 002 | — | SF0 LOAD 60% | MAXIMUM LOAD 20% |
| * 003 | — | SF0 LOAD 80% | MAXIMUM LOAD 20% |
| * 004 | — | SF0 LOAD 100% | MAXIMUM LOAD 20% |
| * 010 | 14 | SF0 LOAD 20% | MAXIMUM LOAD 40% |
| * 011 | 16 | SF0 LOAD 40% | MAXIMUM LOAD 40% |
| * 012 | — | SF0 LOAD 60% | MAXIMUM LOAD 40% |
| * 013 | — | SF0 LOAD 80% | MAXIMUM LOAD 40% |
| * 014 | — | SF0 LOAD 100% | MAXIMUM LOAD 40% |
| * 020 | 12 | SF0 LOAD 20% | MAXIMUM LOAD 60% |
| * 021 | 14 | SF0 LOAD 40% | MAXIMUM LOAD 60% |
| * 022 | 16 | SF0 LOAD 60% | MAXIMUM LOAD 60% |
| * 023 | — | SF0 LOAD 80% | MAXIMUM LOAD 60% |
| * 024 | — | SF0 LOAD 100% | MAXIMUM LOAD 60% |
| * 030 | 11 | SF0 LOAD 20% | MAXIMUM LOAD 80% |
| * 031 | 12 | SF0 LOAD 40% | MAXIMUM LOAD 80% |
| * 032 | 14 | SF0 LOAD 60% | MAXIMUM LOAD 80% |
| * 033 | 16 | SF0 LOAD 80% | MAXIMUM LOAD 80% |
| * 034 | — | SF0 LOAD 100% | MAXIMUM LOAD 80% |
| * 040 | 10 | SF0 LOAD 20% | MAXIMUM LOAD 100% |
| * 041 | 11 | SF0 LOAD 40% | MAXIMUM LOAD 100% |
| * 042 | 12 | SF0 LOAD 60% | MAXIMUM LOAD 100% |
| * 043 | 14 | SF0 LOAD 80% | MAXIMUM LOAD 100% |
| * 044 | 16 | SF0 LOAD 100% | MAXIMUM LOAD 100% |
| * 100 | 32 | SF1 LOAD 20% | MAXIMUM LOAD 20% |
| * 101 | — | SF1 LOAD 40% | MAXIMUM LOAD 20% |
| ⋮ | ⋮ | ⋮ | |

EACH NUMBER OF PULSES IS DETERMINED SO THAT LUMINANCE OBTAINED BY THE CORRESPONDING DISPLAY LOAD MATCHES WITH THAT BY MAX. DISPLAY LOAD.

PANEL DISPLAY IN WHICH THE NUMBER OF SUSTAINING DISCHARGE PULSES IS ADJUSTED ACCORDING TO THE QUANTITY OF DISPLAY DATA, AND A DRIVING METHOD FOR THE PANEL DISPLAY

This is a divisional of application Ser. No. 08/641,894 filed May 2, 1996.

BACKGROUND OF THE INVENTION

Field of the Invention

The present invention relates to a panel display for displaying data by utilizing a memory function for display cells selected from among a plurality of display cells formed at the intersections of a plurality of electrodes arranged in the form of a matrix, and to a driving method for the panel display. More particularly, this invention is concerned with a driving method for a plasma display panel (hereinafter, a PDP) or the like and a panel display adopting the driving method. In particular, the present invention relates to a panel display in which display glowing periods within sub-frames are weighted differently and thus differentiated from one another in order to achieve gray-scale display, and a driving method for the panel display.

In recent years, there have been increasing demands for thinness, diversification of information to be displayed and of conditions for installation, large screens, and high definition in the field of displays. The advent of a display meeting these demands has been awaited. A thin display falls into several types represented by an LCD, fluorescent character display tube, EL, and PDP respectively. In such a thin display, for gray-scale display, one frame is generally composed of a plurality of sub-frames, the sub-frames are weighted differently and thus differentiated from one another, and bits of gray-scale data are displayed during associated sub-frames.

A display using a PDP is attracting attention owing to its superb features such as no flickering, ease in making a screen larger, high luminance, and long service life. Herein, the description will proceed by taking an AC-type PDP for instance. The present invention can apply to the above types of displays.

As for display panels for a picture display available these days, there is a trend toward a larger picture receptor that can be adapted to television conformable to high-definition broadcasting standards such as HDTV and EDTV-II or the wide television conformable to a prevailing National Television System Committee (NTST)-recommended system. However, an existing cathode-ray tube type picture receptor has a limit in size. The color display PDP is therefore predicted to be used as a next-generation television.

The AC-type PDP is such that a voltage is applied alternately to two kinds of sustaining electrodes in order to sustain discharge, and thus a glowing display is achieved. One discharge is completed within one microsecond to several microseconds after application of a pulse. Ions that are positive charges induced by the discharge are accumulated on the surface of an insulating layer over one kind of electrode to which a negative voltage has been applied. Likewise, electrons that are negative charges are accumulated on an insulating layer over the other kind of electrode to which a positive voltage has been applied.

First, cells are discharged by applying a pulse (writing pulse) of a high voltage (writing voltage), and wall charges are produced. Thereafter, a pulse (sustaining pulse) of an opposite polarity and a lower voltage (sustaining voltage) is applied. The previously-accumulated wall charges are then superposed on the sustaining voltage. This results in a high voltage relative to a discharge space. Consequently, a threshold discharge voltage is exceeded and discharge is started. In the cells each having a wall charge produced after one writing discharge, discharge is sustained by applying a sustaining discharge pulse alternately. The feature of the AC-type PDP attributable to the nature of a cell is referred to as a memory effect or a memory function. In general, the AC-type PDP uses the memory function for displaying.

A PDP cannot vary its glowing strength. A luminance is substantially varied by differentiating the lengths of glowing periods from one another, whereby a gray-scale display is achieved. A gray-scale display by the PDP is usually achieved by varying the lengths of glowing periods associated with weights applied to bits of display data. A period of glowing associated with each bit is referred to as a sub-frame. This display system is referred to as a sub-frame system. For example, when 256-level gray-scale display is performed, display data is represented by eight bits. Display of one frame is divided into those of eight sub-frames. Display of each bit data is performed during each sub-frame. The ratio of the lengths of sub-frames is 1:2:4:8:16:32:64:128. One sub-frame is divided into a reset period, addressing period, and sustaining discharge period. During the reset period, a full-screen writing pulse is applied for self-erasing discharge, and all cells in a panel enter a uniform state without any wall charge. Next, during the addressing period, addressing discharge is performed line-sequentially in order to turn on or off the cells according to display data, and a wall charge permitting sustaining discharge is accumulated on cells to be enabled to glow. Thereafter, when the sustaining discharge period is completed, a picture of one sub-frame is displayed. In such an "addressing/sustaining discharge-separated type writing addressing system," a luminance is determined with the length of a sustaining discharge period; that is, the number of sustaining pulses.

In a known AC-type PDP, a plurality of display cells constituting one line are driven by pairs of a common sustaining electrode and a scan electrode. In this case, a current used to show display data on each line is substantially proportional to a quantity of display data (load) in the display cells. Resistive components are distributed within each electrode. The longer an electrode becomes, the larger the resistance of the electrode is. When a display current is supplied, the resistive components in an electrode bring about a voltage drop. The magnitude of a voltage drop is dependent on the quantity of display data. Furthermore, a floating capacitance is originally present between electrodes. Due to the floating capacitance, unnecessary charges are accumulated. This also leads to a voltage drop. The sustaining electrode and the scan electrode are led out alternately in opposite directions. The display luminances of display cells constituting the same line are therefore even. Consequently, a difference in luminance seldom occurs between display cells on the same line irrespective of whether a quantity of display data is larger or small. However, there is a difference in voltage drop between lines according to a quantity of display data on each line. This leads to a difference in display luminance between lines.

The foregoing voltage drop, dependent on a quantity of display data, occurs between sub-frames. That is to say, a sustaining pulse is applied to a sustaining electrode and a scan electrode by a drive circuit referred to as a sustainer. A current supplied by the drive circuit therefore varies depending on the number of cells to be discharged and sustained during each sub-frame; that is, a display load. Consequently, luminances to be attained during sub-frames do not demonstrate a given ratio but fluctuate.

The effective brightness of display during each sub-frame is determined with a luminance attained by sustaining discharge and a length of a sustaining discharge period. The sustaining discharge periods within sub-frames are set according to a given ratio. When the display loads to be imposed during the sub-frames are the same, luminances attained by sustaining discharge are the same. The brightnesses of display attained during the sub-frames demonstrate the same ratio as the sustaining discharge periods within the sub-frames. However, when the display loads to be imposed during the sub-frames are different from one another, the luminance attained by sustaining discharge differs among the sub-frames. The brightnesses of display attained during the sub-frames do not therefore demonstrate the given ratio. When this event occurs, gray scale rendered by combining the sub-frames cannot be displayed precisely. At worst, there arises a problem that brightnesses may be inverted between gray levels.

SUMMARY OF THE INVENTION

An object of the present invention is to minimize a fluctuation in display luminance between lines and a deviation from a given ratio of display luminances to be attained during sub-frames, which are attributable to a variation of a display load.

More particularly, a first object of the present invention is to provide a panel display capable of preventing an occurrence of a difference in luminance between lines during each sub-frame which is dependent on a quantity of display data set on each line, of preventing an occurrence of flickering by guaranteeing a uniform luminance for display data representing a picture, and of faithfully displaying a gray scale of display data on a display panel. A second object of the present invention is to provide a panel display capable of displaying gray scale precisely irrespective of a difference in display load between sub-frames.

A panel display in accordance with the first aspect of the present invention comprises a display panel including a plurality of cells to be selectively discharged to glow, an addressing means for setting the plurality of cells to states represented by display data, and a display glowing means for enabling the plurality of cells to glow according to the set states. In the panel display, display lines are divided into a plurality of blocks each of which includes at least one line. A display data quantity counting means is provided at each block to detect display data to be displayed block by block and then count the number of bits as a quantity of detected display data. Based on a quantity of display data on each block provided by the display data quantity counting means, a frequency of a sustaining discharge is set block by block. Thus, the frequency of a sustaining discharge is controlled.

For controlling the frequency of sustaining discharge block by block, a sustaining discharge control signal counting means is provided to count the number of pulses of a sustaining discharge control signal applied block by block for sustaining discharge. A result of counting the number of bits as a quantity of display data which is provided by the display data quantity counting means is compared with a result of counting pulses of a sustaining discharge signal which is provided by the sustaining discharge frequency counting means. At a time when both the results agree with each other, an enable signal for validating sustaining discharge is produced. A logic operation is then performed on the enable signal and sustaining discharge control signal, whereby the frequency of a sustaining discharge per block is controlled.

A panel display in accordance with the second aspect of the present invention comprises a display panel including a plurality of cells to be selectively discharged to glow, an addressing means for setting the plurality of cells to states represented by display data, and a display glowing means for enabling the plurality of cells to glow according to the set states. In the panel display, one frame during which one screen is displayed is composed of a plurality of sub-frames. A glowing period during which cells are enabled to glow by the display glowing means is weighted differently and thus differentiated among sub-frames, whereby a gray-scale display is achieved. The panel display further comprises a display load calculating means for calculating a display load to be imposed on a full display surface during each sub-frame, and a corrected period calculating means for calculating a corrected period of a glowing period, during which cells are enabled to glow by the display glowing means according to a display load to be imposed during each sub-frame, which is calculated by the display load calculating means, so that brightnesses attained by display cells during sub-frames will demonstrate a given ratio. The panel display is characterized in that the display glowing means enables cells to glow during corrected periods.

Various methods are available for calculating a corrected period. For example, there is a method in which a corrected period is calculated so that a brightness will be matched with the one attained with imposition of a display load of 100% of a full load that is a maximum value of a display load within a variation range. Another method is such that a corrected period is calculated so that a brightness will be matched with the one attained with imposition of the same display load as that to be imposed during a sub-frame during which the largest display load is imposed. Yet another method is such that a weighted mean of display loads to be imposed during sub-frames is calculated in consideration of weighting, and then a corrected period is calculated so that a brightness will be matched with the one attained with imposition of a display load of the weighted mean. Still another method is such that a median of display loads to be imposed during sub-frames is calculated and then a corrected period is calculated so that a brightness will be matched with the one attained with imposition of a display load of the median.

In the calculation of a corrected period, a total sum of corrected display glowing periods should not exceed a given length; that is, a length allocated to display glowing periods within one frame.

A change in brightness between sub-frames deriving from a change in luminance occurs due mainly to the influence of a sub-frame of which a discharge glowing period is long and assigned a large weight. For simplifying computation, therefore, a corrected period may be calculated by calculating a display load to be imposed during a sub-frame to which a large weight is assigned, and setting a given display load for the other sub-frames.

BRIEF DESCRIPTION OF THE DRAWINGS

The present invention will be more clearly understood from the description as set forth below with reference to the accompanying drawings, wherein:

FIG. 4 is a block diagram of a known drive circuit for the triple-electrode surface-discharge AC type PDP;

FIG. 21 is a table showing data in the sustaining pulse ROM in the known panel display;

FIG. 26 is a timing chart showing waveforms of driving signals to be applied during one sub-frame in the third embodiment;

FIG. 30 is a table showing data in a sustaining pulse ROM in the fourth embodiment;

DESCRIPTION OF THE PREFERRED EMBODIMENTS

Before proceeding to a detailed description of the preferred embodiments of the present invention, prior art plasma displays will be described, with reference to the accompanying drawings thereof, for a clearer understanding of the differences between the prior art and the present invention.

An AC type PDP can be a dual-electrode type in which two kinds of electrodes are used for selective discharge (addressing discharge) and sustaining discharge (discharge for display glowing) or a triple-electrode type in which the third electrode is used for addressing discharge. In a color PDP capable of performing gray-scale display, phosphors formed in discharge cells are excited by ultraviolet light stemming from a discharge. The phosphor has a drawback that it is prone to the impact of ions that are positive charges also stemming from discharge. The dual-electrode type has a structure in which phosphors are hit directly by ions. There is therefore the fear that the service lives of phosphors may be shortened. To avoiding the shortening, color PDPs generally adopt the triple-electrode structure utilizing surface discharge. Furthermore, the triple-electrode type can be a type in which the third electrode is formed on a substrate on which the first and second electrodes responsible for sustaining discharge are arranged or a type in which the third electrode is mounted on another substrate opposed to the substrate containing the first and second electrodes. Moreover, even when three kinds of electrodes are formed on the same substrate, the third electrode may be placed over or under the two electrodes responsible for sustaining discharge. Furthermore, visible light emanating from a phosphor may be transmitted by the phosphor for visualization (transparent type) or reflected by the phosphor for visualization (reflective type). Moreover, the spatial coupling of a cell to be discharged with an adjoining cell can be disconnected by a rib or barrier. The rib or barrier may be placed in four ways in order to enclose a discharge cell and thus fully seal off the cell. Alternatively, the rib or barrier may be placed in only one way. In this case, coupling in any other way is cut off by optimizing a gap (distance) between electrodes. The present invention can apply to a plasma display panel (PDP) of any of the above types. Herein, description will proceed by taking a panel of the reflective type in which: the third electrode is formed on a substrate opposed to a substrate containing electrodes responsible for sustaining discharge; a rib or barrier is formed in a vertical direction alone (that is, a direction orthogonal to the first and second electrodes and parallel to the third electrode); and part of a sustaining electrode is formed with a transparent electrode.

Figure 1:
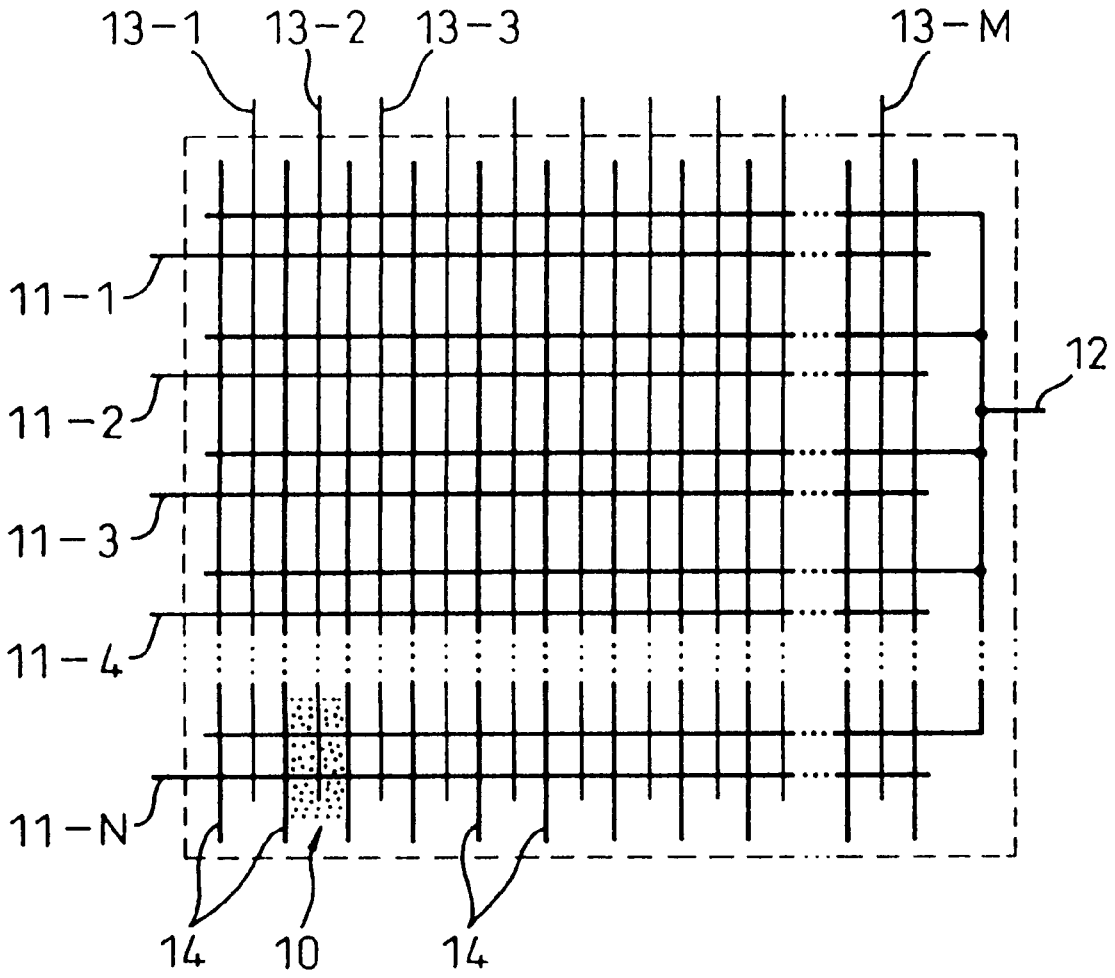
FIG. 1 is a schematic plan view of a triple-electrode surface-discharge AC type PDP.
Figure 2:
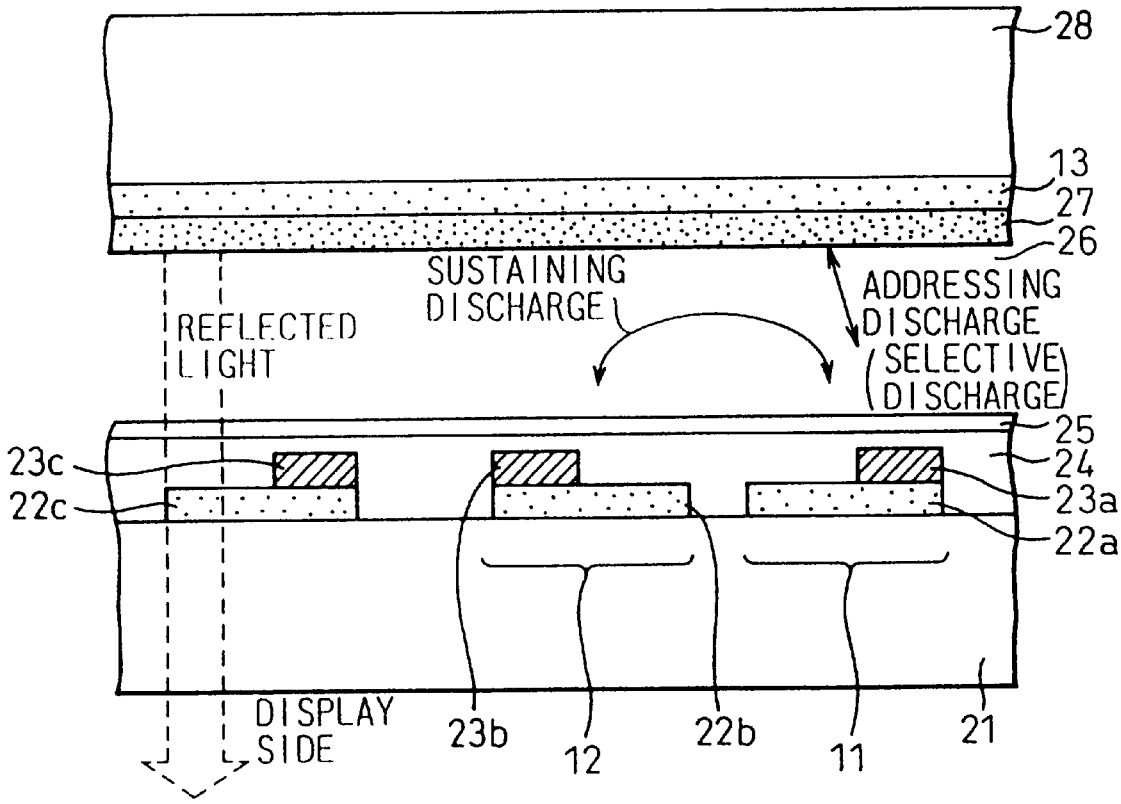
FIG. 2 is a schematic sectional view of the triple-electrode surface-discharge AC type PDP.
Figure 3:
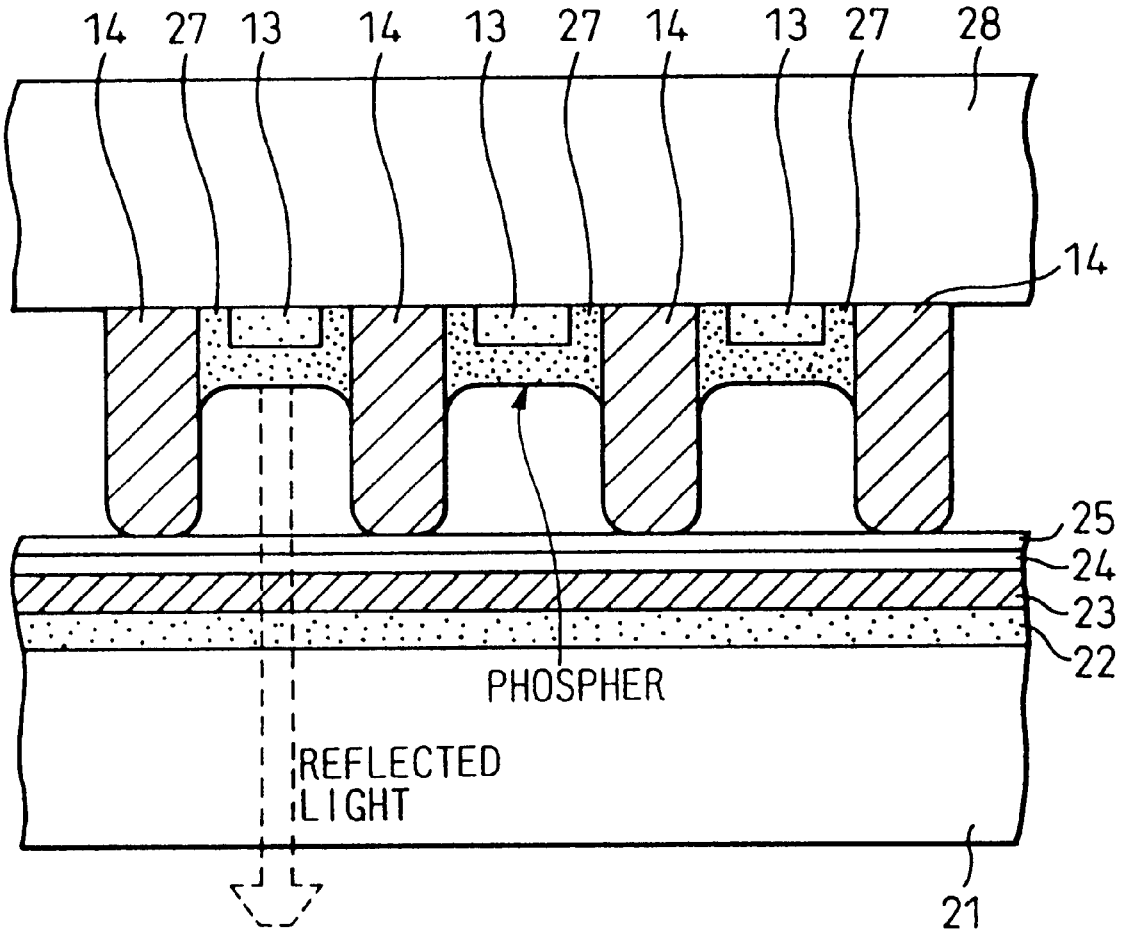
FIG. 3 is a schematic sectional view of the triple-electrode surface-discharge AC type PDP.

A PDP shown in the schematic plane view of FIG. 1 is well-known as the triple-electrode surface-discharge type PDP. FIG. 2 is a schematic sectional view (vertical direction) of one discharge cell in the panel in FIG. 1. FIG. 3 is a schematic sectional view showing the discharge cell in the horizontal direction. In the drawings referenced below, the same functional components will be assigned the same reference numerals.

A panel is composed of two glass substrates 21 and 28. The first substrate 21 has first electrodes (X electrodes) 12 and second electrodes (Y electrodes) 11 which are parallel to each other and serve as sustaining electrodes. These electrodes are formed with transparent electrodes 22*a* and 22*b* and bus electrodes 23*a* and 23*b*. The transparent electrode fills the role of transmitting reflected light emanating from a phosphor and is therefore formed with an ITO (a transparent conducting membrane made mainly of indium oxide). The bus electrode must be formed to have a low resistance in order to prevent a voltage drop deriving from an electrical resistance and is therefore made of chrome (Cr) or copper (Cu). Furthermore, the first electrodes and second electrodes are covered with a dielectric layer (glass) 24. A membrane made of magnesium oxide (MgO) is formed as a protective membrane on a discharge side. The third electrodes (address electrode) 13 are formed on the second substrate 28 opposed to the first glass substrate 21 so that the third electrodes will be orthogonal to the sustaining electrodes. A barrier 14 is formed between each pair of address electrodes. A phosphor 27 having the characteristic of glowing in red, green, and blue is formed between each pair of barriers 14 so that the phosphor can cover an associated address electrode. The two glass substrates are assembled so that the ridges of the barriers 14 will come into close contact with the MgO surface 25. A space between each phosphor 27 and the MgO surface 25 is a discharge space 26.

In a plasma display panel 100 in a plasma display shown in FIG. 4, pairs of a first electrode realized with a sustaining electrode X constituting X electrodes and second electrodes realized with scan electrodes Y1, Y2, Y3, etc., and Yn (where n denotes any positive integer) constituting Y electrodes are arranged to be parallel to one another and coincident with respective lines. Third electrodes realized with address data electrodes D1, D2, D3, etc., and Dn constituting address electrodes are arranged to be opposed to and orthogonal to the first and second electrodes. A plurality of display cells are thus formed in a flat matrix fashion at intersections between the pairs of the first and second electrodes and the third electrodes.

Referring to FIG. 4, a plurality of kinds of drivers for driving the display cells in the plasma display panel 100 in a known plasma display, and the circuitry of a control circuit for controlling the drivers, will be described. In FIG. 4, drivers include an address data driver 31 for performing data driving; that is, for driving the address electrodes constituting one line for the purpose of performing addressing discharge on the display cells, and an X common driver 41 for performing sustaining discharge driving (that is, sustaining driving); that is, for driving the X electrodes for the purpose of performing sustaining discharge on the display cells. Furthermore, a scan driver 52 is included to consecutively scan the Y electrodes; that is, the scan electrodes Y1 to Yn (n equals, for example, 480) so as to write data being set on one line by the address data driver 31 during an addressing period during which selective writing discharge is performed. Moreover, a Y common driver 53 is included to perform sustaining driving during a sustaining discharge period (that is, a sustaining period). The Y common driver 53 is connected to a Y scan driver 52. The Y scan driver 52 applies a sustaining pulse produced by the Y common driver 53 to its own power supply, and performs sustaining driving in common on the Y electrodes.

In FIG. 4, there is a control circuit 61 for controlling all the operations of the plasma display including the address data driver 31, X common driver 41, Y common driver 53, Y scan driver 52, and plasma display panel 100. The major portion of the control circuit 61 is composed of a display data control portion 62 for controlling display data by performing addressing discharge on a plurality of display cells, and a drive timing control unit 63 for controlling the timing of driving display cells in the plasma display panel 100 by means of the various kinds of drivers.

To be more specific, the display data control portion 62 includes a display data processing portion 621 for rearranging externally-input data streams used for color display (red display data R7 to R0, green display data G7 to G0, and blue display data B7 to B0) into data used to drive the plasma display, and a frame memory 622 for temporarily storing rearranged display data streams and transferring the data streams consecutively to the address data driver 31 in the form of a display data signal A-DATA, which is used to control addressing discharge, during an addressing period, and a frame memory control circuit 623 for reading or writing (R/W) the frame memory 622 according to proper timing.

The drive timing control unit 63 includes a PDP timing signal generating portion 631 for converting dot clock CLK, blanking signal XBLANK, vertical synchronizing (hereinafter sync) signal XVsync, and horizontal sync signal, which are input externally, into internal control signals used for display in the plasma display 100. The PDP timing signal generating portion 631 controls input display data, whereby a driving sequence to be followed by the X common driver 41, Y common driver 53, and Y scan driver 52 is provided.

Furthermore, the drive timing control unit 63 includes an address driver control portion 632 for outputting a clock A-CLK used to control addressing discharge so as to drive the address data driver 31, a Y scan driver control portion 633 for driving the Y scan driver 52, and a common driver control portion 634 for driving the X common driver 41 and Y common driver 53. Typically, a scan data signal Y-DATA concerned with scanning of the scan electrodes Y1 to Yn constituting the Y electrodes for data display and composed of a plurality of bits, and a clock Y-CLK concerned with the data scanning are input to the Y scan driver 52.

Figure 5:
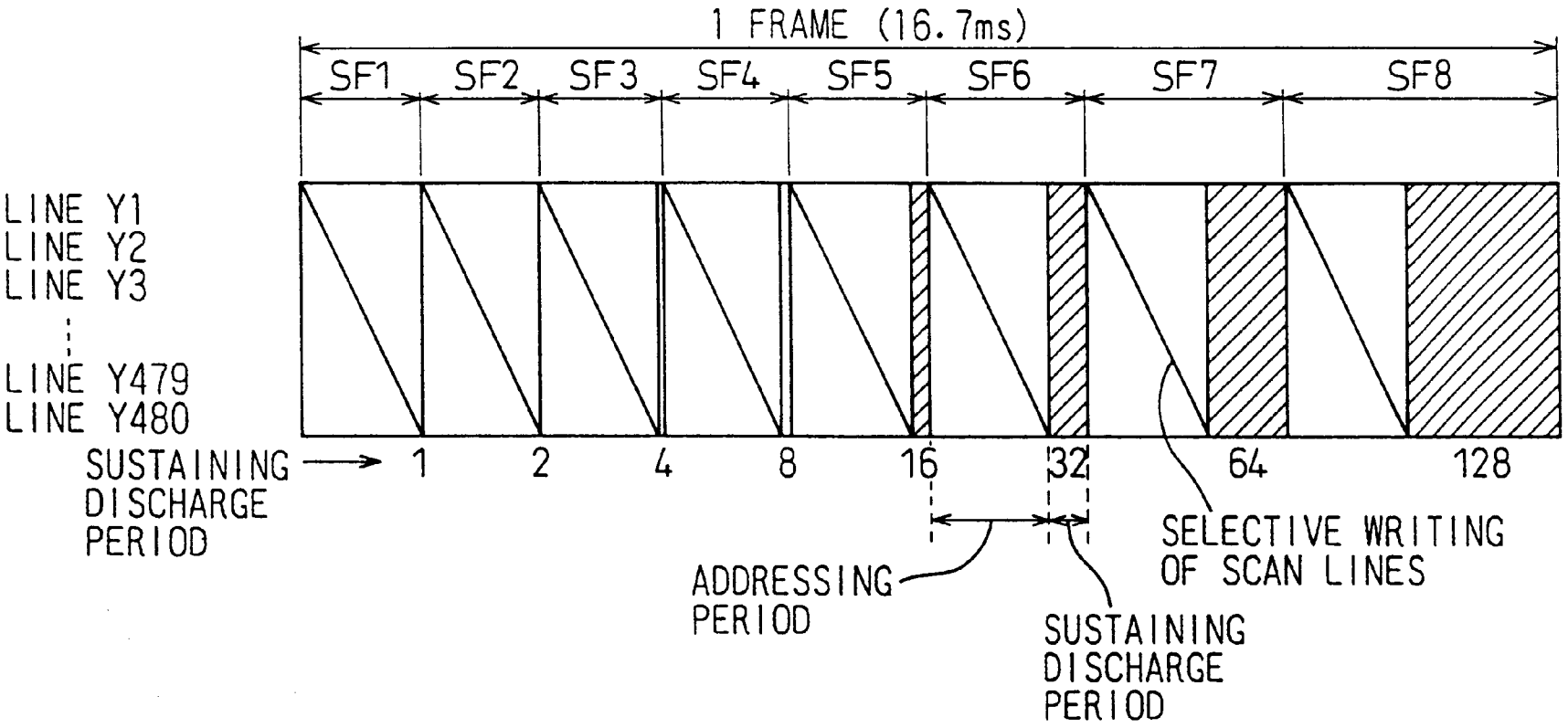
FIG. 5 is a timing chart concerning a display system in which one frame is composed of a plurality of sub-frames in order to achieve gray-scale display.
Figure 6:
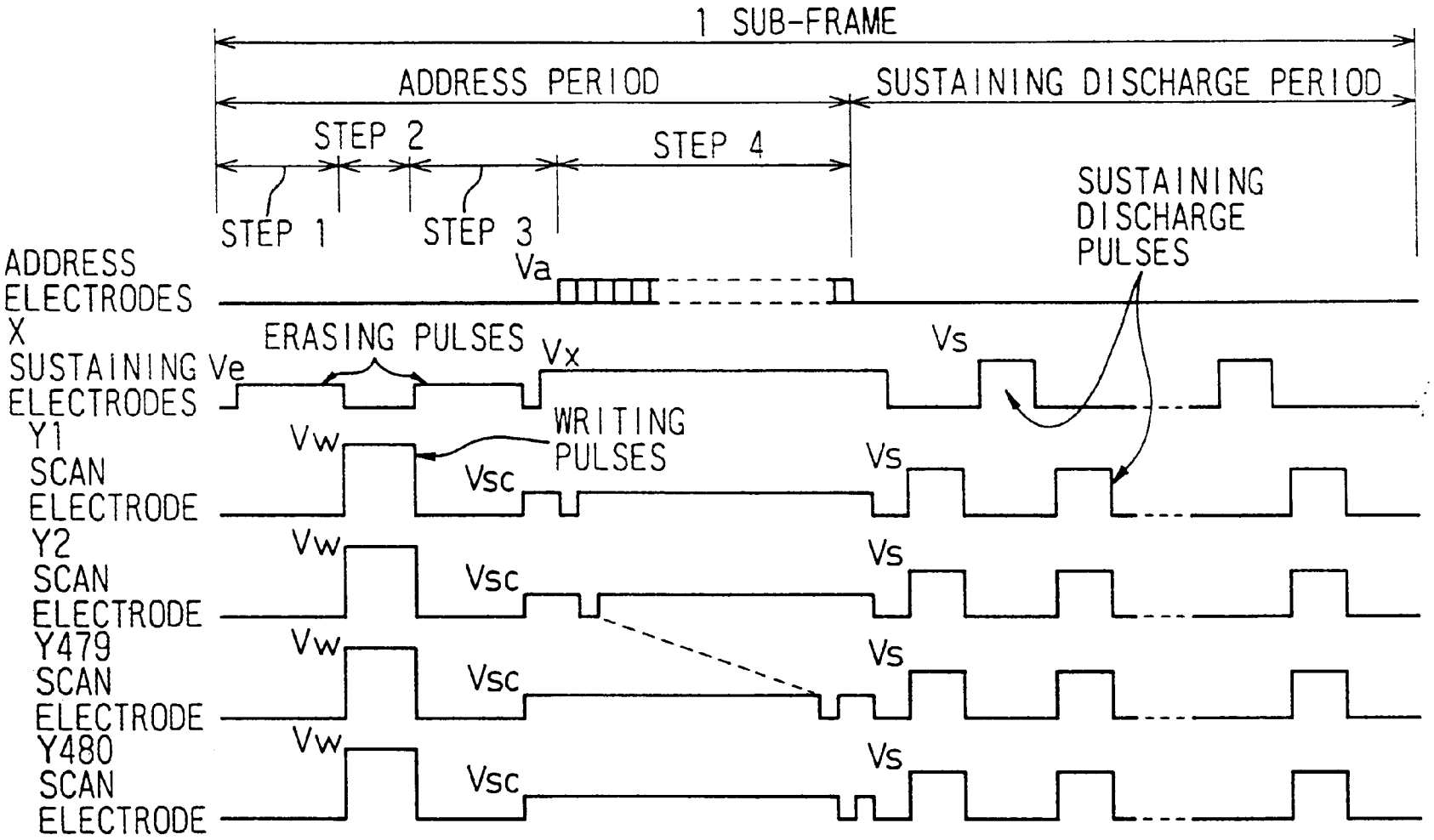
FIG. 6 is a timing chart showing waveforms of driving signals to be applied during one sub-frame in a known panel display.

FIG. 5 shows a state in which a plurality of sub-frames are defined for a plasma display panel used for a known plasma display. FIG. 6 is a timing chart showing waveforms of driving signals to be applied during one sub-frame in the known plasma display.

Herein, as shown in FIGS. 5 and 6, for example, the number of sub-frames defined by dividing one frame of 16.7 milliseconds (msec.) is set to 8. A driving sequence is defined by combining these sub-frames properly, so that 256-level gray-scale display can be achieved in, for example, a non-interlaced driving mode. Each sub-frame is divided into an addressing period during which display data is written according to a weight assigned to this sub-frame, and a sustaining period during which addressed display data is displayed. The sub-frames are superposed on one another in order to display one frame picture.

In FIG. 6, at step 1 in an addressing period within a certain sub-frame, an erasing pulse (erasing discharge pulse) of an erasing discharge voltage Ve is applied to the sustaining electrode X serving as the X electrodes in order to initialize all display cells. At step 2, a writing pulse of a writing voltage Vw triggering writing discharge is applied to the scan electrodes Y1 to Y480 (which also function as sustaining electrodes) serving as the Y electrodes coincident with all lines. At step 3, an erasing pulse used to accumulate a wall charge uniformly in the display cells constituting each line is applied again to the sustaining electrode X serving as the X electrodes. At step 4, an addressing pulse of an addressing voltage Va is applied to the address data electrodes D1 to Dn. At the same time, a data scanning pulse of a scan control supply voltage Vsc is selectively applied to the address data electrodes D1 to Dn according to display data to be displayed. The various electrodes are thus driven by following the steps 1 to 4, whereby the display cells in the PDP are selectively discharged for writing.

During a sustaining period succeeding the addressing period, a sustaining pulse of a supply voltage Vs, which is used to control sustaining discharge and is lower than the writing voltage Vw, is applied to the sustaining electrode serving as the X electrodes and the scan electrodes Y1 to Y480 serving as the Y electrodes coincident with all lines. Thus, display cells that have been discharged for writing once and have produced a wall charge can be continually discharged to glow by applying the sustaining pulse alternately.

Figure 7:
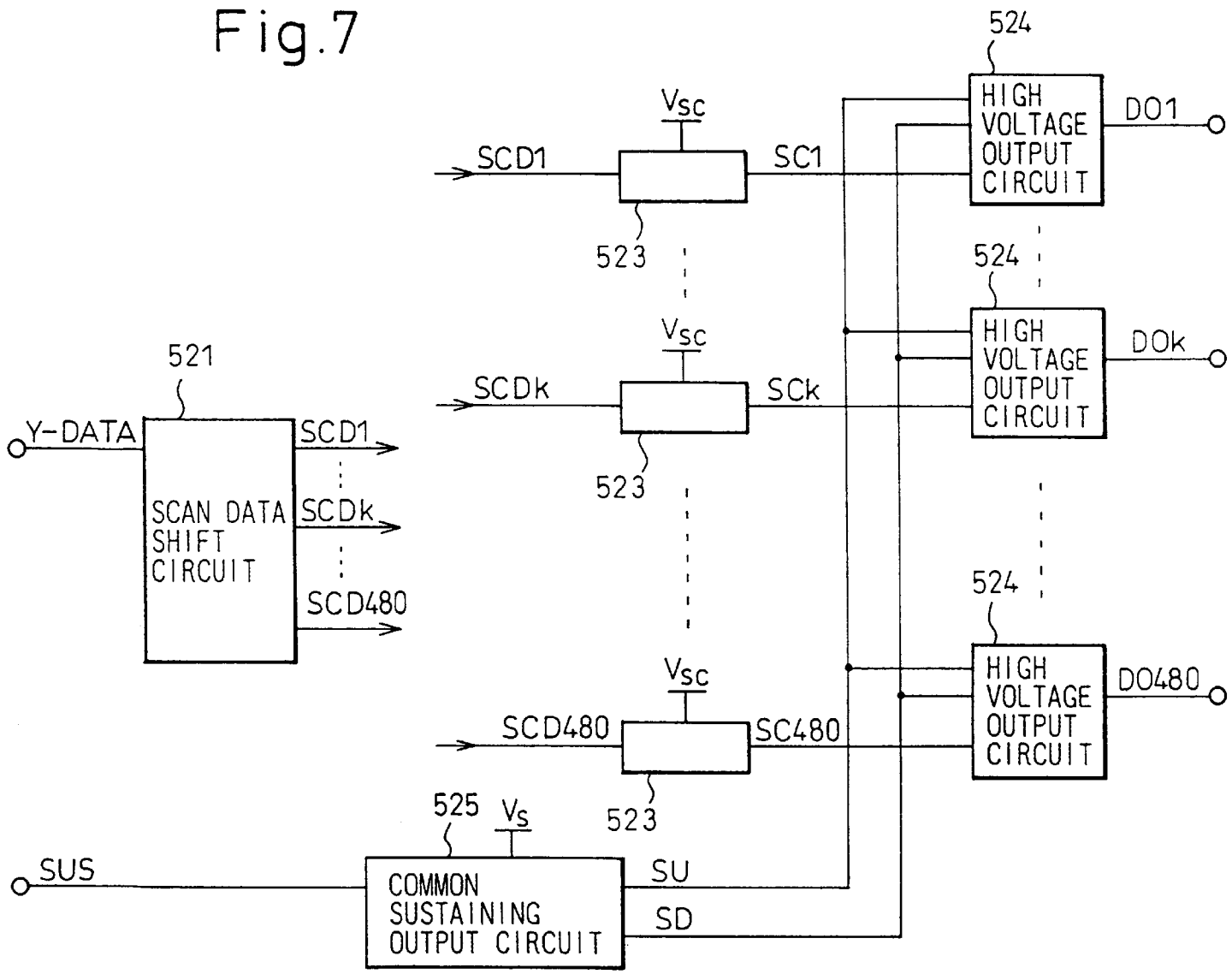
FIG. 7 is a circuit diagram showing the configuration of a scan driver in the known panel display.

FIG. 7 is a circuit diagram showing the configuration of a scan driver in the known plasma display shown in FIG. 4. The scan driver shown in FIG. 7 includes the Y common driver 53 and Y scan driver 52 shown in FIG. 4.

In the drawing, reference numeral 521 denotes a scan data shift circuit. 523 denotes a scan output circuit. 524 denotes a high-voltage output circuit associated with any of the scan electrodes Y1 to Y480 constituting the Y electrodes. 525 denotes a common sustaining output circuit for driving in common all the scan electrodes Y1 to Y480 coincident with all lines.

In FIG. 7, scan data SCD1, etc., SCDk, etc., and SCD480 ($1 \leqq k \leqq 480$) are selected line by line by the scan data shift circuit 521, and then input to the associated scan output circuits 523. Scan pulses (SC1, etc., SCk, etc., and SC480) are produced respectively by some of the scan output circuits 523 associated with the lines selected with specific scan data contained in the scan data SCD1, etc., SCDk, etc., and SCD480 respectively, and are then output respectively to the plurality of high-voltage output circuits 524 on the succeeding stages. Common sustaining driving signals SU and SD used for sustaining driving are supplied in common from the common sustaining output circuit 525 to these high-voltage output circuits 524 associated with with all the lines. These common sustaining driving signals SU and SD are synthesized with the scan pulses and then output to the Y electrodes (output signals DO1, etc., DOk, etc., and DO480).

In the known plasma display, the Y electrodes coincident with all the lines are subjected in common to sustaining driving. A difference in luminance dependent on a load between lines cannot therefore be compensated for.

In the known plasma display 100, a sustaining pulse is applied to the display cells, which have been written with data by the address data driver 31 and are located on the sustaining electrode serving as the X electrodes and the sustaining electrodes serving as the Y electrodes (that is, scan electrodes), by the X common driver 41 and Y common driver 53. The application of a sustaining pulse is performed in common over the full screen for the purpose of display driving.

As mentioned above, in the known AC type plasma display, each of the pairs of the common sustaining electrodes serving as the X electrodes and the scan electrodes serving as the Y electrodes drives a plurality of display cells constituting one line. In this case, a current used to show display data on each line is substantially proportional to a quantity of display data (load) existent in associated display cells. Resistive components are distributed within each electrode. The longer an electrode becomes, the higher the resistance of the electrode is. The resistive components in an electrode bring about a voltage drop at the time of supply of a display current. The magnitude of the voltage drop is dependent on the quantity of display data. Furthermore, a floating capacitance is originally present between electrodes. Unnecessary charges are therefore accumulated due to the floating capacitance. This also leads to a voltage drop. When the quantity of display data increases, the potentials at each ends of an electrode become different. This results in a difference in display luminance between lines.

Figure 8A:
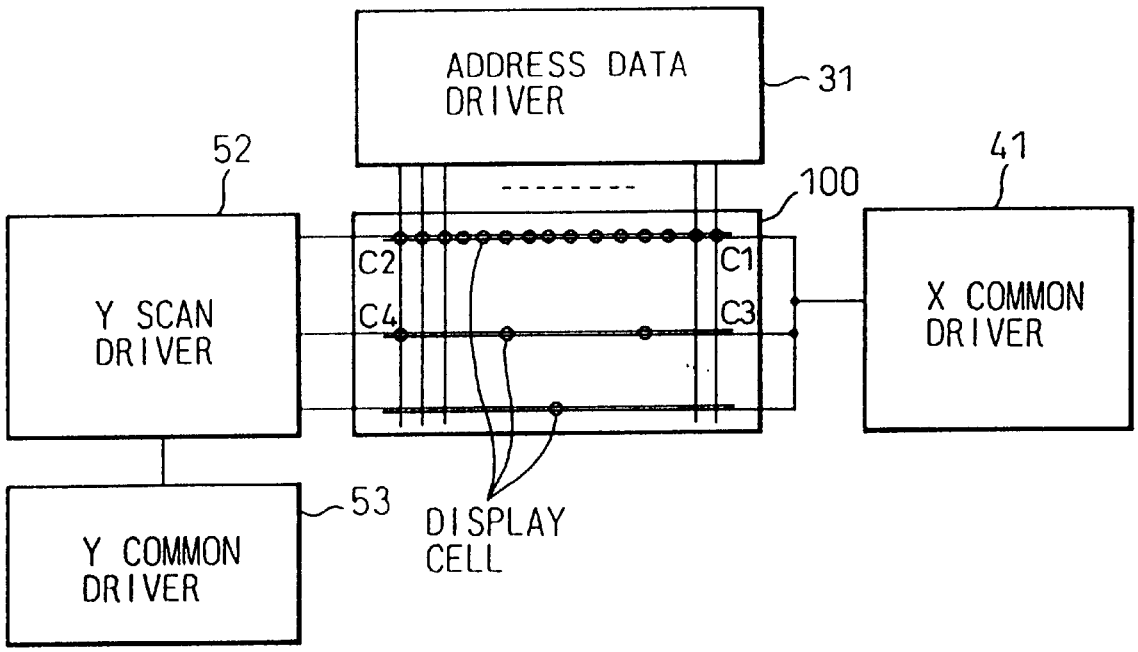
FIGS. 8A and 8B are graphic diagrams showing an occurrence of a difference in luminance between lines due to the dependency on a quantity of display data.
Figure 8B:
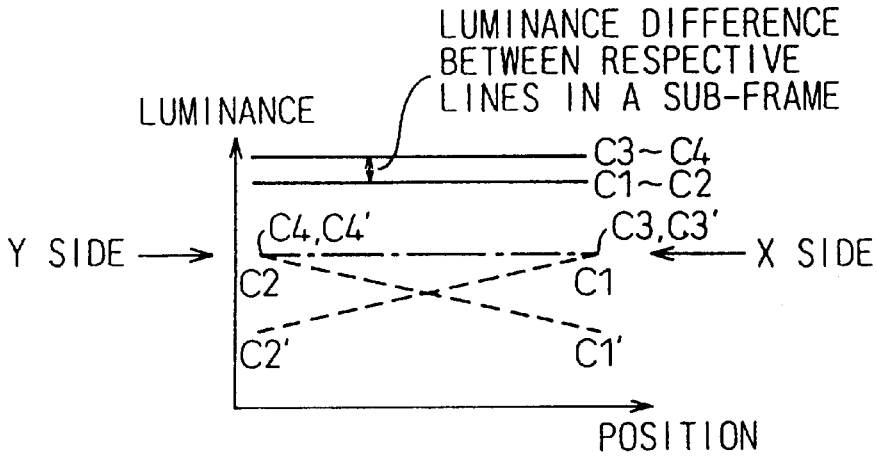

Occurrence of a difference in luminance between lines during a certain sub-frame is shown graphically in FIGS. 8A and 8B. In FIG. 8A, the sustaining electrodes serving as the X electrodes and the scan electrodes serving as the Y electrodes are led out alternately in opposite directions. As is apparent from the comparison of a change in luminance between positions C1 and C2' on the X electrodes with a change in luminance between positions C2 and C1' on the Y electrodes, the display luminances of display cells constituting the same line even out. A difference in luminance between display cells on the same line hardly occurs irrespective of whether the quantity of display data is large or small. However, for example, as far as a line coincident with an X electrode linking positions C3 to C4' and with a Y electrode linking positions C3' to C4' is concerned, a quantity of display data is much smaller than that on the previous line. Thus, as apparent from the graph of FIG. 8B, a difference in luminance between lines occurs between a line having a large quantity of display data and a line having a small quantity of display data. Specifically, a line having a large quantity of display data (for example, a line linking C1 and C2) has a low luminance and is darker because of a large load. By contrast, a line having a small quantity of display data (for example, a line linking C3 and C4) has a high luminance and is brighter.

Figure 9:
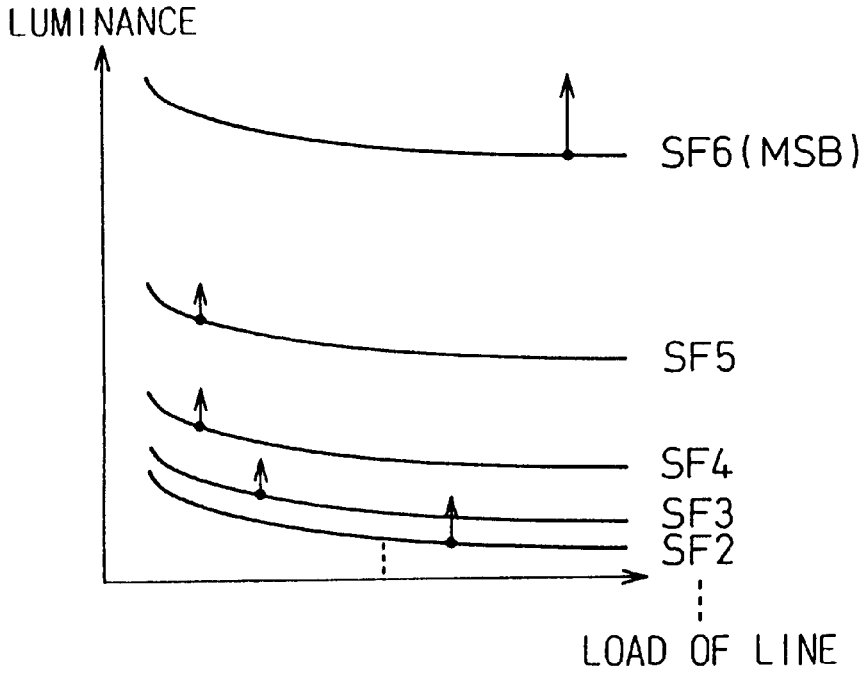
FIG. 9 is a graph showing the characteristic of a luminance dependent on a load to be imposed on a line during each sub-frame.
Figure 10:
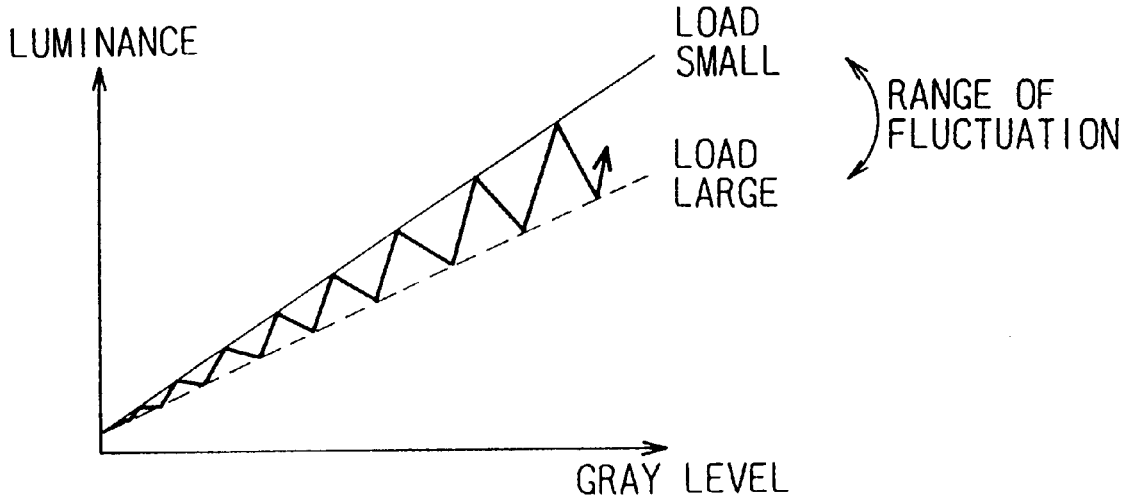
FIG. 10 is a graph showing fluctuations in luminance between loads in relation to gray levels.

FIG. 9 is a graph showing the characteristic of a luminance dependent on a load to be imposed on a line during each sub-frame in the known plasma display in which one frame is composed of six sub-frames. FIG. 10 is a graph showing fluctuations in luminance between loads in relation to gray levels.

In conjunction with FIG. 8, a process of causing a difference in luminance between lines during one certain sub-frame has been described. When a plurality of sub-frames are superposed on one another for multilevel gray-scale display, there is a possibility that a difference in luminance caused by a difference in load (loads to be imposed during sub-frames are indicated with arrows extending from line load characteristic curves SF2 to SF6 (SF6 is associated with the most significant bit MSB) may become larger than a difference in luminance between gray levels. As a result, gray scale, which should originally be rendered smoothly according to the load characteristics of the sub-frames shown in FIG. 9, poses a problem that gray scale appears with an intermittent luminance characteristic suggesting several occurrences of a gray-scale inversion phenomenon.

The known PDP has the foregoing problems. Next, an embodiment of the present invention for solving these problems will be described.

Figure 11:
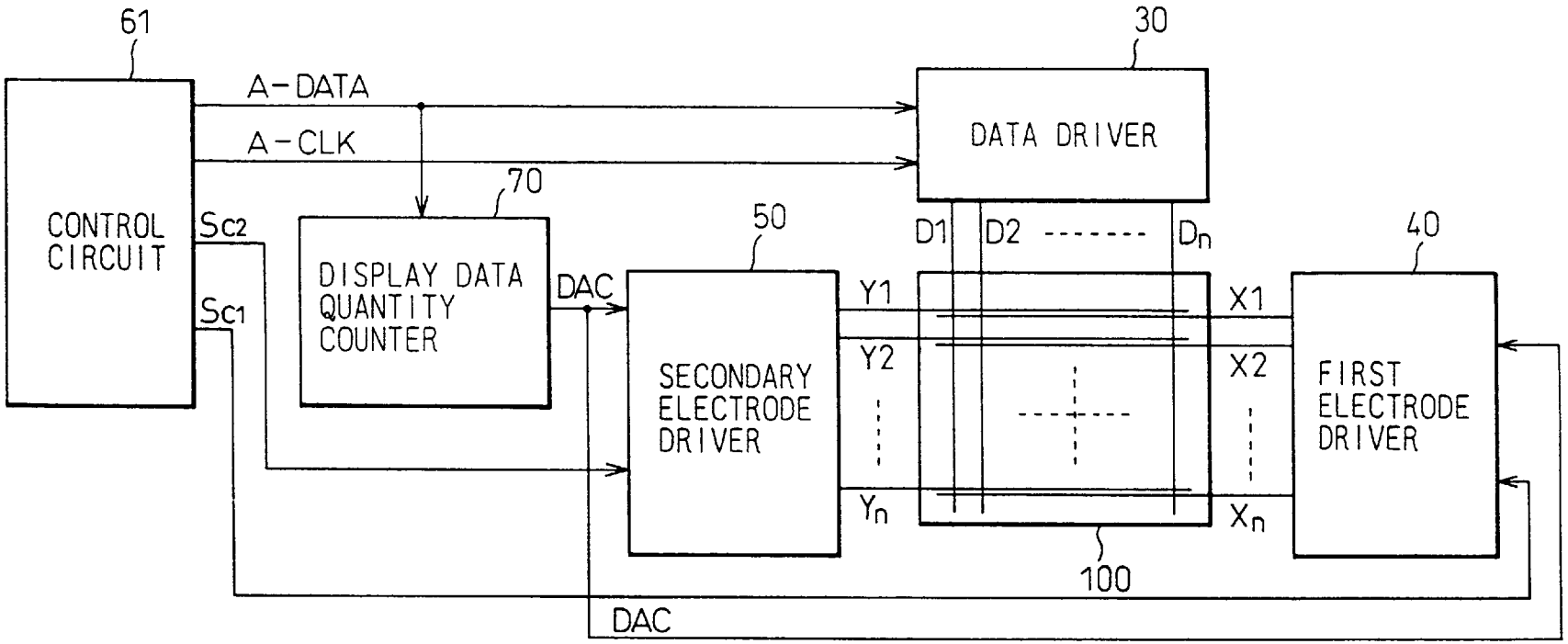
FIG. 11 is a block diagram showing the basic configuration of a PDP of the first mode of the present invention.

FIG. 11 is a block diagram showing the principles and configuration of the first aspect of the present invention. Herein, a triple-electrode surface-discharge AC type plasma display (AC type PDP) will be described as a typical panel display.

In a display panel 100 in the panel display shown in FIG. 11, similarly to the known configuration, pairs of a plurality of first electrodes (for example, sustaining electrodes X1, X2, etc., and Xn) and a plurality of second electrodes (for example, scan electrodes Y1, Y2, etc., and Yn) are arranged to be parallel to one another and coincident with lines. A plurality of third electrodes (for example, address data electrodes D1, D2, etc., and Dn) are arranged to be opposed to and orthogonal to the first and second electrodes. A plurality of display cells are formed in a planar matrix fashion at intersections between the first and second electrodes and the third electrodes.

A plurality of drivers for driving these display cells include a first electrode driver 40 for supplying a first control signal Sc1 used to control sustaining discharge to the first electrodes and for driving the display cells for sustaining discharge or the like, a second electrode driver 50 for supplying a second control signal Sc2 used to control sustaining discharge to the second electrodes and for driving the display cells for sustaining discharge or the like, and a data driver 30 for supplying a control signal used to control addressing discharge (for example, a display data signal A-DATA, and clock A-CLK) to the third electrodes and for writing data selectively in the display cells.

In panel display of the first aspect of the present invention, display lines are dived into a plurality of blocks each of which includes at least one line. A display data quantity counter 70 for detecting display data to be displayed block by block and for counting the number of bits as a quantity of detected display data is provided at each block. Based on a result of counting the number of bits as a quantity of display data by means of the display data quantity counter 70, a frequency of sustaining discharge performed by pairs of the first and second electrodes is set block by block. The frequency of sustaining discharge is thus controlled.

In the following descriptions, examples in which each block includes only one line, namely, a display data quantity counter 70 is provided at each line are described.

Figure 12:
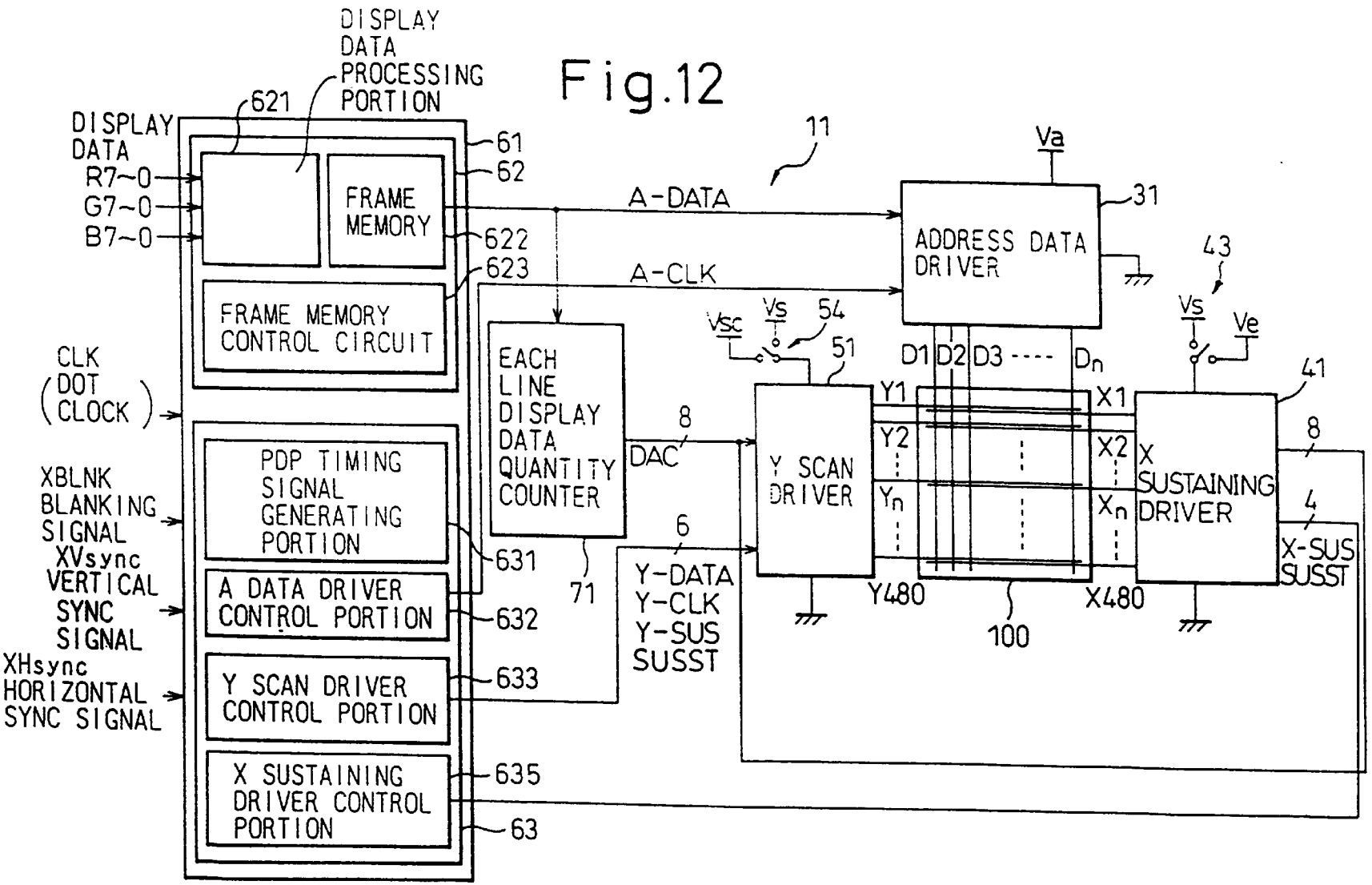
FIG. 12 is a block diagram showing the configuration of the first embodiment.

FIG. 12 is a block diagram showing the configuration of the first embodiment of the present invention. The description of components similar to those in the known plasma display shown in FIG. 4 will be omitted.

The first electrode driver 40 and second electrode driver 50 as well as the control circuit 61 for controlling these drivers have the same circuitries as those shown in FIG. 4. The other components will be described.

In FIG. 12, an address data driver 31 for performing data driving; that is, for driving the address electrodes constituting one line for the purpose of performing addressing discharge on the plurality of display cells is, similarly to the known plasma display, used as the data driver 30.

Furthermore, an X sustaining driver 41 for performing sustaining driving; that is, for driving the sustaining electrodes X1 to X480 serving as the X electrodes for the purpose of performing sustaining discharge on the display cells is used as the first electrode driver 40.

Furthermore, an Y scan driver 51 for performing data scanning; that is, for scanning the scan electrodes Y1 to Y480 serving as the Y electrodes 53 consecutively so as to write the data, which has been set for one line by the address data driver 31, during an addressing period during which selective writing discharge is carried out, and for performing sustaining driving during a sustaining period is used as the second electrode driver 50.

Furthermore, the X sustaining driver 41 includes a switching circuit 43 for switching a supply voltage used to control sustaining discharge (that is, used for sustaining control); that is, a sustaining voltage Vs, and a supply voltage used to control erasing discharge; that is, an erasing voltage Ve. On the other hand, the Y scan driver 51 includes a switching circuit 54 for switching the sustaining voltage Vs and a supply voltage used to control scanning; that is, a scanning voltage Vsc. When scanning control, which makes it possible to perform data scanning on display cells 22 constituting one line, and sustaining control are executed concurrently, the switching circuit 54 is used to switch the sustaining voltage Vs and supply voltage Vs, or the supply voltage used to control scanning or sustaining voltage Vs and scanning voltage Vsc. Thus, the Y scan driver 51 alone can perform both of driving of the display cells 22 for scanning control and driving thereof for sustaining control.

In FIG. 21, the control circuit 61 is included to control all the operations of the plasma display 11 including the address data driver 31, X sustaining driver 41, and Y scan driver 51. The major portion of the control circuit 61 is composed, similarly to that in FIG. 4, or the display data control portion 62 for controlling display data by performing addressing discharge on a plurality of display cells, and the drive timing control unit 63 for controlling the timing of driving the display cells in the plasma display panel by means of the various drivers.

To be more specific, the display data control portion 62 includes the display data processing portion 621 for rearranging data streams input externally and used for color display (red display data R7 to R0, green display data G7 to G0, and blue display data B7 to B0) into data used to drive the plasma display, the frame memory 622 for temporarily storing the rearranged display data streams and transferring the data streams consecutively to the address data driver 31 in the form of a display data signal A-DATA to be used to control addressing discharge during an addressing period, and the frame memory control circuit 623 for reading or writing the frame memory 622 according to proper timing.

On the other hand, the drive timing control unit 63 includes the PDP timing signal generating portion 631 for converting various signals such as a dot clock CLK, blanking signal XBLNK, vertical sync signal XVsync, and horizontal sync signal XHsync, which are input externally, into internal control signals used for display in the plasma display 11. The PDP timing signal generating portion 631 controls input display data, whereby a driving sequence to be followed by the X sustaining driver 41 and Y scan driver 51 is defined.

Furthermore, the drive timing control unit 63 includes the address driver control portion 632 for outputting a clock A-CLK used to control addressing discharge so as to drive the address data driver 31, an X sustaining driver control block 635 for driving the X sustaining driver 41, and a Y scan driver control block 633 for driving the Y scan driver 51.

The X sustaining driver control block 635 produces a sustaining discharge control signal (that is, a sustaining control signal) X-SUS to be applied to the sustaining electrodes X1 to X380 constituting the X electrodes, and a sustaining discharge start signal (that is, a sustaining start signal) SUSST used to define the start of production of the sustaining control signal X-SUS, and sends them to the X sustaining driver 41.

On the other hand, the Y scan driver control block 633 produces a scan data signal Y-DATA that is used for data scanning to be performed on the scan electrodes Y1 to Y480 constituting the Y electrodes and composed of a plurality of bits, a clock Y-CLK used for data scanning, a sustaining control signal Y-SUS to be applied to the scan electrodes Y1 to Y480, and a sustaining start signal SUSST for defining the start of production of the sustaining control signal Y-SUS, and then sends them to the Y scan driver 51.

In FIG. 12, an each line display data quantity counter 71, which counts the number of bits as a quantity of display data to be set on each line on the basis of a display data signal A-DATA sent from the frame memory 622 and used to control addressing discharge, is included as the every line display quantity counter 70 that is a constituent feature of the present invention.

The each line display data quantity counter 71 provides a digital output corresponding to a count, which indicates a quantity of display data to be set on each line, and consisting of a plurality of bits (herein, eight bits). The digital output; that is, a display data quantity output signal DAC is compared with the number of pulses of a sustaining control signal which is counted by a sustaining discharge control signal counting means included in the X sustaining driver 41 responsible for sustaining driving or the Y scan driver 51. The X sustaining driver 41 and Y scan driver 51 drive electrodes so as to continue sustaining discharge (sustaining) until the count indicating the quantity of display data and being represented by the display data quantity output data signal DAC agrees with the number of sustaining pulses. Thus, the number of sustaining pulses to be applied to a line having a large quantity of display data is made larger than that to any other line. This makes it possible to compensate for a difference in luminance between lines.

Figure 13:
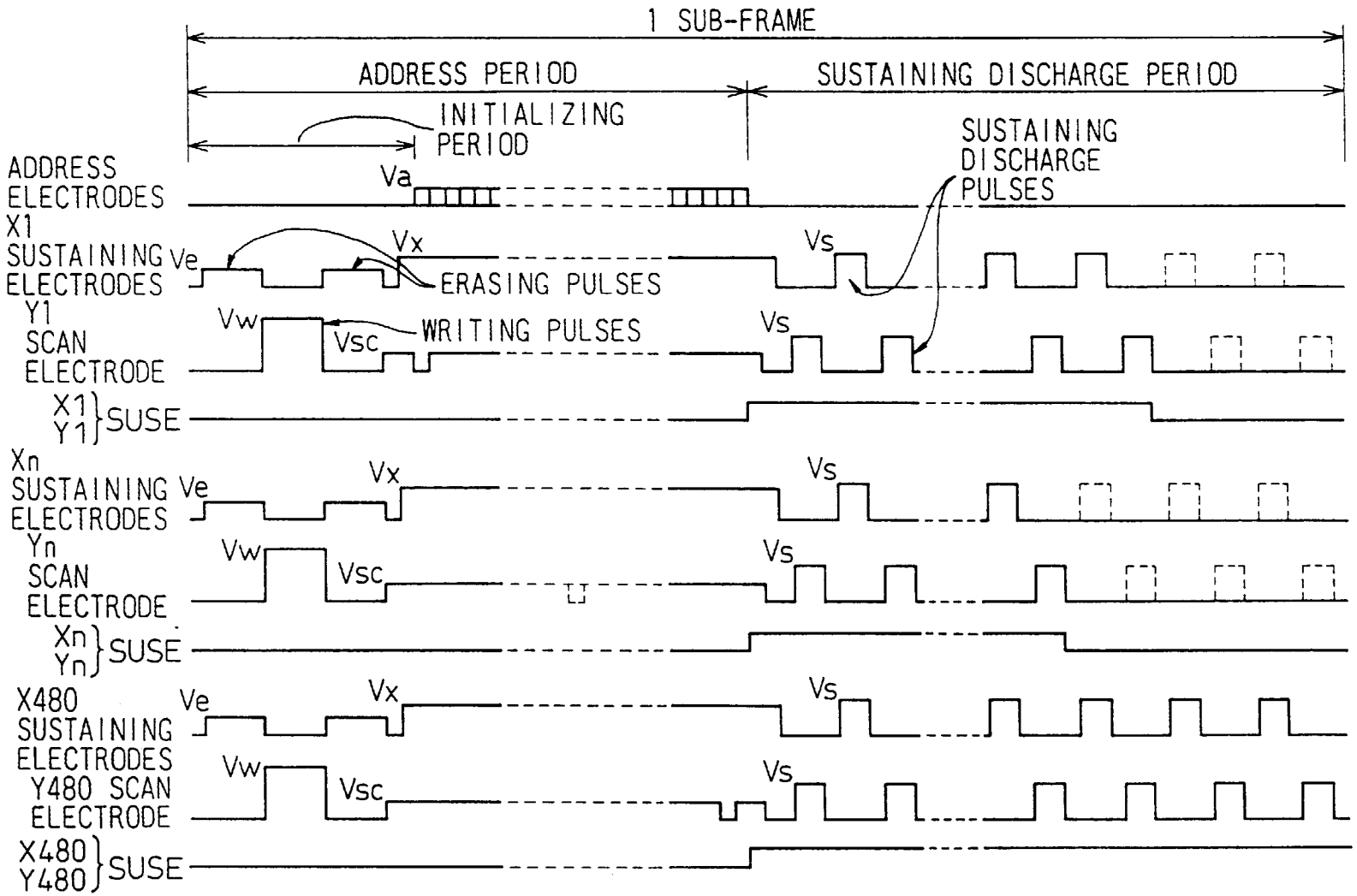
FIG. 13 is a timing chart showing waveforms of driving signals to be applied during one sub-frame in the first embodiment.

FIG. 13 is a timing chart showing waveforms of driving signals to be applied during one sub-frame in the embodiment of the present invention.

A sub-frame in FIG. 13 is, similarly to that in FIG. 6, divided into an addressing period during which display data corresponding to a weight assigned to the sub-frame is written and a sustaining period during which addressed display data is displayed. Sub-frames are superposed on one another, whereby one frame picture is displayed.

In FIG. 13, the steps 1 to 3 described in conjunction with FIG. 6 are performed during an initializing period within an addressing period during a certain sub-frame. To be more specific, first, an erasing pulse of an erasing discharge voltage Ve used to initialize the display cells 22 connected to the sustaining electrodes X1 to X480 coincident with the lines is applied to the sustaining electrodes X1 to X480. Next, a writing pulse of a writing voltage Vw used to trigger writing discharge is applied to the scan electrodes Y1 to Y480 coincident with the lines. Moreover, an erasing pulse used to accumulate a wall charge uniformly on the display cells constituting the lines is applied again to the sustaining electrodes X1 to X480. During a succeeding addressing period, similarly to step 4 in FIG. 6, an addressing pulse of an addressing voltage Va is applied to the address electrodes D1 to Dn.

At the same time, a data scanning pulse of a scanning voltage Vsc is applied selectively to the addressing electrodes D1 to Dn according to display data to be displayed.

During a sustaining period succeeding the addressing period, a sustaining pulse of a sustaining voltage Vs, which is lower than the writing voltage Vw, is applied to the sustaining electrodes X1 to X480 and scan electrodes Y1 to Y480 which are coincident with the lines. In other words, glowing discharge of selected display cells can be sustained by performing sustaining on the pairs of the sustaining electrodes and scan electrodes coincident with the lines.

In FIG. 13, the dashed line in an area defined as a sustaining period indicates a sustaining pulse whose generation frequency has been adjusted by an enable signal SUSE to be applied to the sustaining electrodes X1 to X480 and scan electrodes (which also function as sustaining electrodes) coincident with the lines. The enable signal SUSE to be applied to each line is a control signal produced line by line on the basis of a disable signal SUSD for invalidating a sustaining pulse and a sustaining start signal SUSST for defining the start of sustaining discharge. As mentioned above, in this embodiment of the present invention, the enable signal SUSE is produced according to a result of counting the number of bits as a quantity of display data to be set on each line. Thus, the number of sustaining pulses to be applied within a specified period during each sub-frame can be decreased in units of a line. Consequently, it becomes easier to attain a uniform luminance over all the lines in the PDP. Besides, it becomes possible to achieve multilevel gray-scale display with better linearity without the occurrence of gray-scale inversion or discontinuity irrespective of whether or not a load corresponding to a quantity of display data is not even among the lines.

Figure 14:
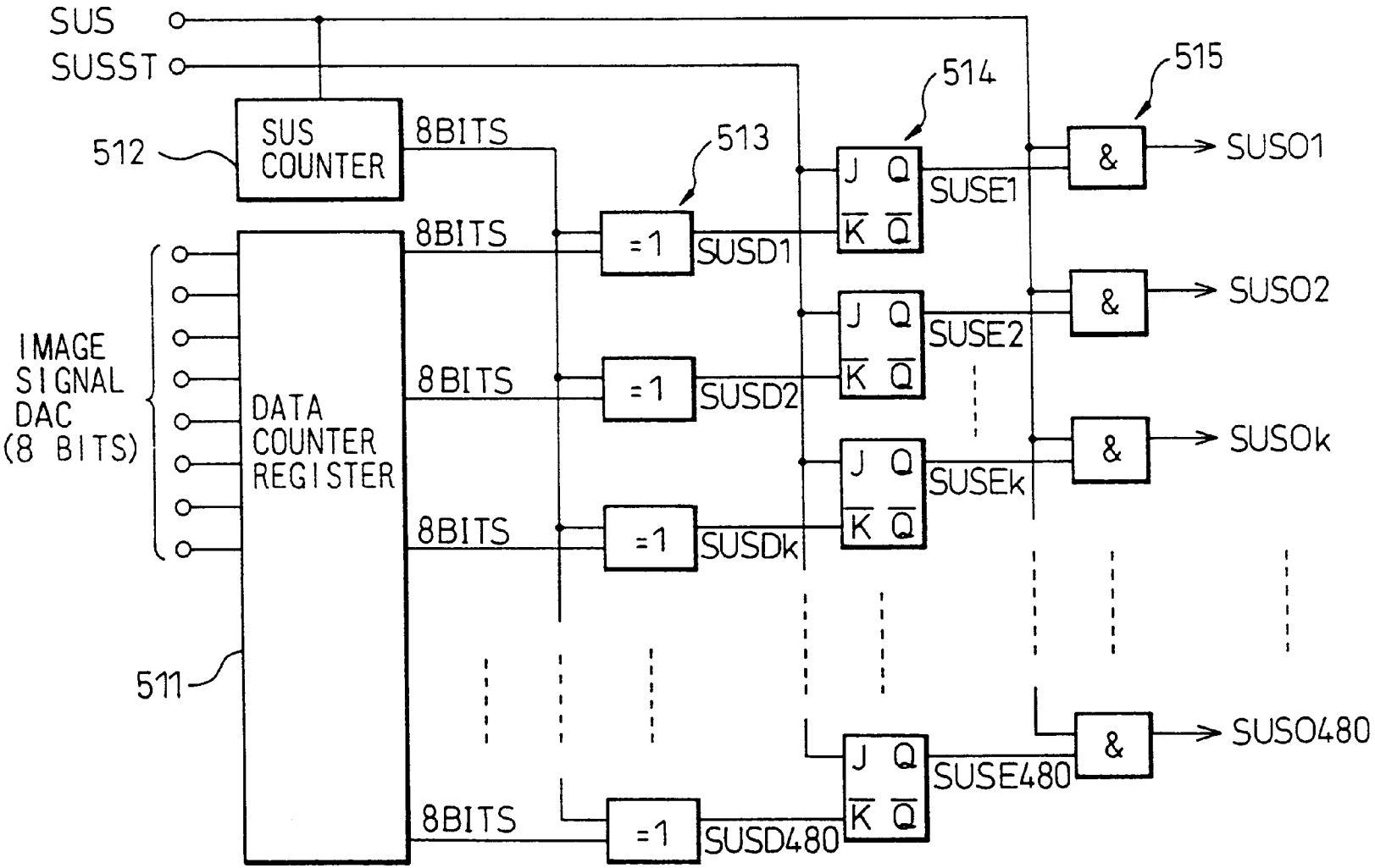
FIG. 14 is a circuit diagram showing an example of the circuitry of an each line sustaining control circuit included in a scan driver in the first embodiment.

FIG. 14 is a circuit diagram showing an example of the circuitry of each line sustaining control circuit included in a scan driver in this embodiment of the present invention. In this case, the scan driver includes the Y scan driver 51 shown in FIG. 2.

The each line sustaining control circuit shown in FIG. 14 includes a sustaining discharge control signal counting circuit for counting pulses of a sustaining control signal SUS and comparing a result of counting pulses with a display data quantity output data signal DAC.

The each line sustaining control circuit in FIG. 14 further includes a data counter register 511. The data counter register 511 receives the display data quantity output data signal DAC, which is output in the form of an 8-bit image signal from the each line display data quantity counter 71 shown in FIG. 12, during an addressing period, and stores display data that is an object of data scanning and consecutively input line by line. Furthermore, the data counter register 511 has the ability to output the stored 8-bit display data simultaneously line by line at the time of a transition from the addressing period to a sustaining period.

The sustaining discharge control signal counting circuit in the each line sustaining control circuit includes a sustaining discharge control signal counter (hereinafter a sustaining counter) 512 for counting sustaining pulses to be applied during a sustaining period.

Furthermore, agreement judging circuits 513 are placed on the output stage of the sustaining discharge control signal counter 512. The agreement judging circuits 513 each input line by line an 8-bit output signal from the data counter register 511 and sustaining counter 512 respectively. When both the output signals agree with each other, the agreement judging circuits 513 each output a disable signal SUSD for invalidating the sustaining control signal SUS to enable signal producing units 514. Herein, the disable signals SUSD each varying depending on a quantity of display data to be set on each line are different from one another. The disable signals SUSD associated with the lines are denoted as SUSD1, SUSD2, etc., SUSDk, etc., and SUSD480. The enable signal producing units 514 each produce an enable signal SUSE for enabling a sustaining control signal SUS during only a period from application of the sustaining start signal SUSST used in common among all lines to define the start of a sustaining period and application of the disable signals SUSD1 to SUSD480 used differently among the lines. The enable signals SUSE are also associated with the respective lines and different from one another, and therefore denoted as SUSE1, SUSE2, etc., SUSEk, etc., and SUSE480. The enable signals SUSE1, SUSE2, etc., SUSEk, etc., and SUSE480 output from the enable signal producing units 514, and the sustaining control signal SUS are fed to logic circuits 515 including AND circuits and the like. Consequently, line-by-line sustaining control signals SUSO1, SUSO2, etc., SUSOk, etc., and SUSO480 to be supplied to the lines coincident with the plurality of scan electrodes Y1 to Y480 are produced. Furthermore, these line-by-line sustaining control signals SUSO1 to SUSO480 are input to gates of high-voltage output stages associated with the lines.

Figure 15:
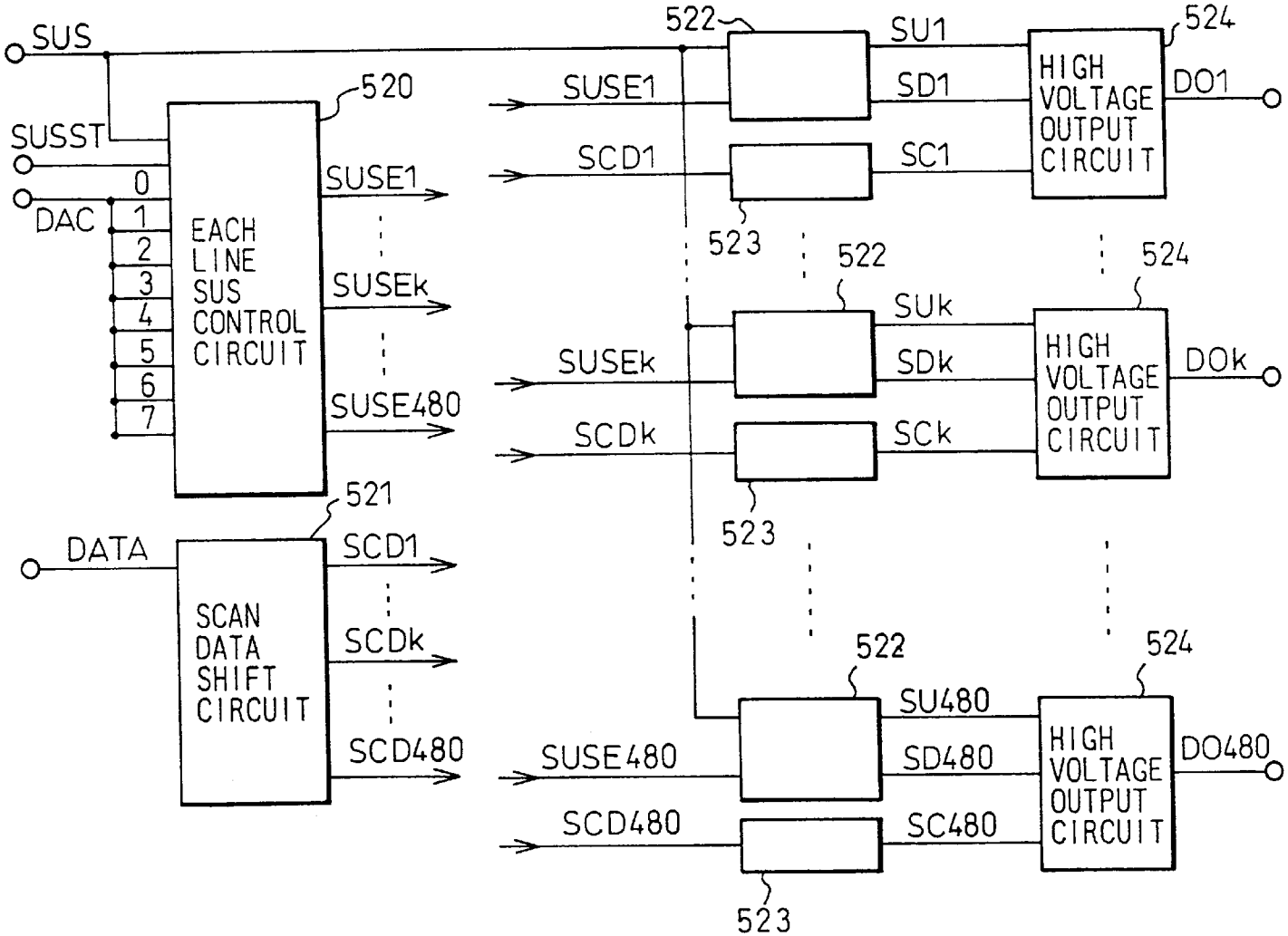
FIG. 15 is a circuit diagram showing the circuitry of the scan driver in the first embodiment.

FIG. 15 is a circuit diagram showing the circuitry of a scan driver in this embodiment of the present invention. As described previously, even in FIG. 15, circuit elements identical to those in FIG. 7 are assigned the same reference numerals.

The high-voltage output stages in the scan driver shown in FIG. 15 are installed independently line by line so that the plurality of scan electrodes Y1 to Y480 can be driven independently.

In the drawing, reference numeral 520 denotes an each line sustaining control circuit, an example of which is shown in FIG. 14. The each line sustaining control circuit produces a display data quantity output data signal DAC (herein an 8-bit signal) equivalent to a count signal sent from the each line display data quantity counter 71 shown in FIG. 12, a sustaining start signal SUSST indicating the start of a sustaining period, and an enable signal SUSE. 522 denotes a line-by-line high-voltage output control circuit formed with a logic circuit that handles enable signals SUSE associated with the lines and a sustaining control signal SUS. The line-by-line high voltage output control circuits 522 control sustaining driving performed by high-voltage output circuits 524 in the succeeding stages.

As mentioned above, in the scan driver shown in FIG. 15, sustaining driving signals SU1, SD1, etc., SUk, SDk, etc., SU480, and SD480, which are driven by the line-by-line high-voltage output control circuits 522, and scan pulses SC1, etc., SCk, etc., and SC480, which are driven by scan output circuits 523, are synthesized by the high-voltage output circuits 524, and then output to the Y electrodes (output signals DO1, etc., DOk, etc., and DO480). Owing to this circuitry, sustaining control can be performed separately according to a load (quantity of display data) to be set on each line. Eventually, display can be realized with a difference in luminance between lines compensated for.

Herein, when the logical state of an input port, through which a display data signal DATA is input, of each of high-voltage output stages in the Y scan driver 51 in the scan driver is fixed (for example, to a low-level state), the high-voltage output stages can be shared with the X sustaining driver 41 that does not perform line-by-line data scanning.

Figure 16:
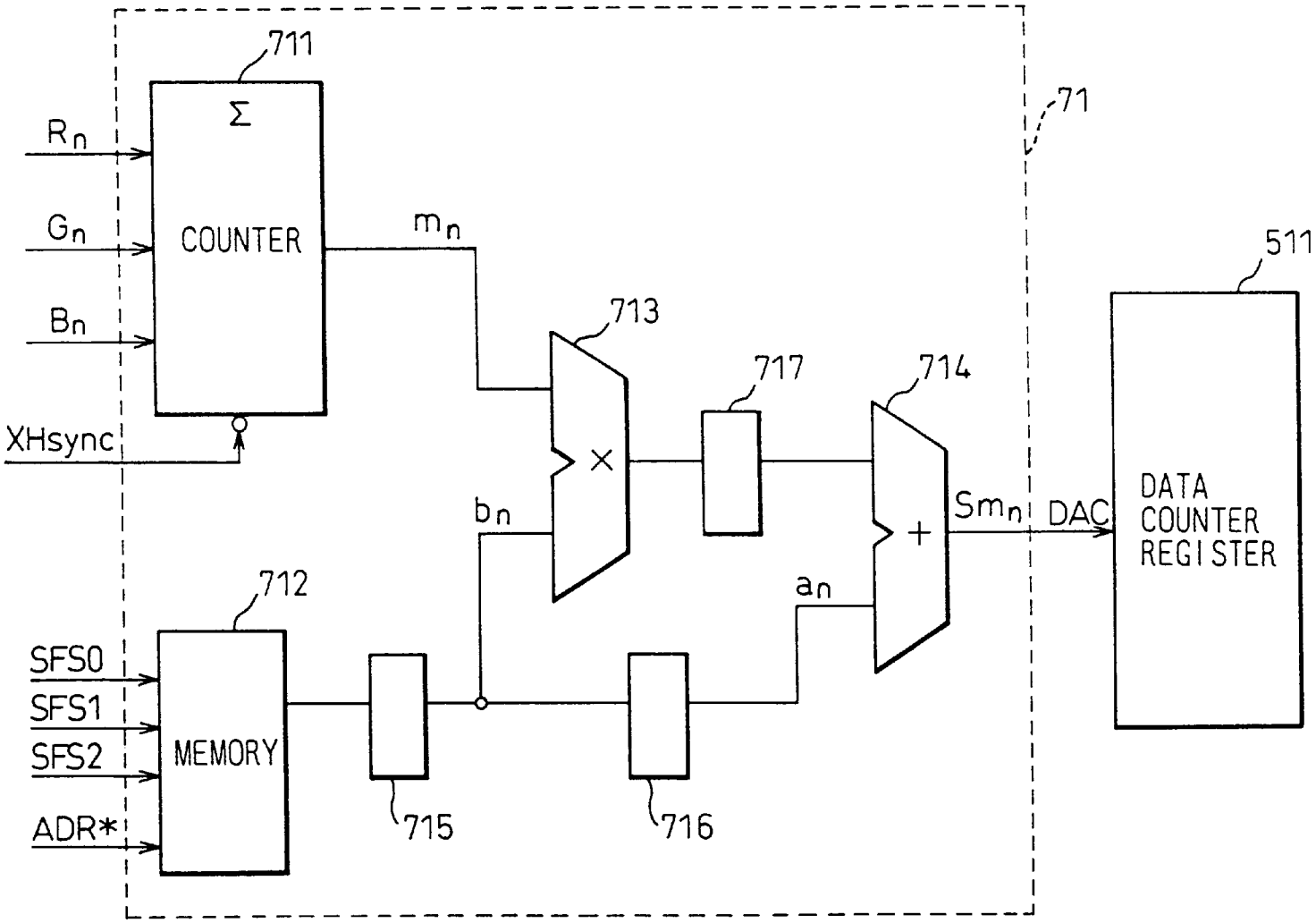
FIG. 16 is a circuit diagram of an each line display data quantity counter in the first embodiment.

FIG. 16 is a circuit diagram showing an example of the circuitry of an each line display data quantity counter in this embodiment of the present invention. Herein, an example of the practical circuitry of the each line display data quantity counter 71 shown in FIG. 12 will be described in detail.

In FIG. 16, reference numeral 711 denotes a counter for counting the number of bits as a quantity of display data to be set on each line during the n-th sub-frame. A signal indicating a count value output by the counter 711; that is, a display data quantity signal $m_n$ is, for example, a signal representing six high-order bits.

In FIG. 16, reference numeral 712 denotes a memory including a RAM or the like. The memory 712 loads a signal SFS* (for example, SFS0, SFS1, or SFS2) indicating the state of a sub-frame, and at least one address signal ADR* used to specify a storage address of display data, and also loads coefficients of computation $a_n$ and $b_n$.

In FIG. 16, reference numeral 713 denotes a multiplier for multiplying a coefficient of computation $b_n$ of, for example, 6 bits long by a display data quantity signal $m_n$ ($b_n*m_n$). 714 denotes an adder for adding a product provided by the multiplier 713 (for example, a signal representing 8 high-order bits) and a coefficient of computation $a_n$ ($a_n+b_n*m_n$). 715, 716, and 717 denote data latches. 511 denotes the same data counter register as the one shown in FIG. 4.

As shown in FIG. 16, assuming that display data signals concerning red, green, and blue, which are used to perform color display during the n-th sub-frame, are Rn, Gn, and Bn, the counter 711 counts the number of bits as a quantity of display data to be set on each line synchronously with a horizontal sync signal XHsync, and produces a count output signal. A signal representing, for example, 6 high-order bits of the count output signal is supplied as a display data quantity signal $m_n$. In this case, the multiplier 713 and adder 714 perform the computation of $Sm_n=a_n+b_n*m_n$ on the basis of the display data quantity signal $m_n$ and the coefficients of computation $a_n$ and $b_n$ loaded from the memory 712.

A frequency of sustaining discharge to be performed on the line which is calculated by the computation; that is, a sustaining frequency $Sm_n$, is stored as an 8-bit display data quantity output data signal DAC in the data counter register 511. At the stage succeeding the data counter register 511, the signal DAC is compared with a frequency of actually-executed sustaining. Thus, line-by-line luminance compensation is realized. On the other hand, the coefficients of computation $a_n$ and $b_n$ used to determine the relationship between a quantity of display data to be displayed during the sub-frame and a sustaining frequency to be performed during the sub-frame are saved in the memory 712. When a signal SFS* indicating the state of a sub-frame and an address signal ADR* are input to the memory 712, after an address is specified, data is loaded. The data thus loaded in the memory 712 is input to the multiplier 713 and adder 714 by the data latches 715 and 716 respectively. The data latch 717 is used to arrange timing of computation.

Now, the procedure of the computation $Sm_n=a_n+b_n*m_n$ will be described in detail There is the relationship below between the number of display data bits to be set on each line during a certain sub-frame SFn (n-th sub-frame), which is represented by a display data quantity signal $m_n$, (herein, for convenience' sake, the number of display data bits is denoted by $m_n$) and a glowing luminance $Bm_n$.

$$Bm_n=B0-\alpha*m_n$$

$$\alpha=(B0-Ba)/m_n(\text{a constant})$$

where B0 denotes a luminance attained when only one display cell (one dot) on one line is enabled to glow, Ba denotes a luminance attained when all display cells on one line are enabled to glow, and $m_n$ denotes the number of all display cells on one line. In this case, for brevity's sake, the glowing luminance $Bm_n$ presumably decreases in inverse proportion to the number of display. data bits to be set on the line, $m_n$.

As apparent from the relational expression between the number of display data bits $m_n$ and the glowing luminance $Bm_n$, when the number of display cells differs between lines during the same sub-frame, a difference in luminance occurs between the lines, though the same glowing luminance should be attained on the lines. Assuming that the luminance difference is ΔB, the following expression is established:

$\Delta B=\alpha*\Delta m$ (where Δm denotes a difference in number of display cells enabled to glow)

It is the gist of the present invention that a sustaining frequency is controlled between lines in order to vary the luminance Bo and thus to compensate for the luminance difference ΔB.

Incidentally, the glowing luminance Bo attained on a certain line and the sustaining frequency S have the relationship represented by the following expression:

$\Delta Bo=\beta*\Delta S$ (where β is a constant and denotes a glowing luminance attained by single sustaining)

However, herein, for brevity's sake, a glowing luminance is regarded to be simply proportional to a sustaining frequency. When the sustaining frequency is larger than 1, the glowing luminance of a background of a picture can be ignored. The above relational expression has been devised by leaving the glowing luminance of a background out of consideration.

Assuming that the sustaining frequency S equals S+ΔS, the glowing luminance Bo becomes equal to Bo+ΔBo. The following relationship is then established:

$$\Delta Bo=\Delta*\Delta S$$

When the ΔB value is made equal to the ΔBo value in order to compensate for a luminance difference, $$\alpha*\Delta m=\beta*\Delta S$$

$$\therefore \Delta S=(\alpha/\beta)*\Delta m$$

where α equals to $(Bo-Ba)/m_n$ and β equals to Bo/So.

When the sustaining frequency S=So attained when the quantity of display data $m_n$ equals to 1 is used as a reference, the sustaining frequency $Sm_n$ for the quantity of display data $m_n$ is expressed as follows:

$$Sm_n=(\alpha/\beta)*(m_n-1)+So$$

$$=b_n*m_n+a_n$$

Figure 17:
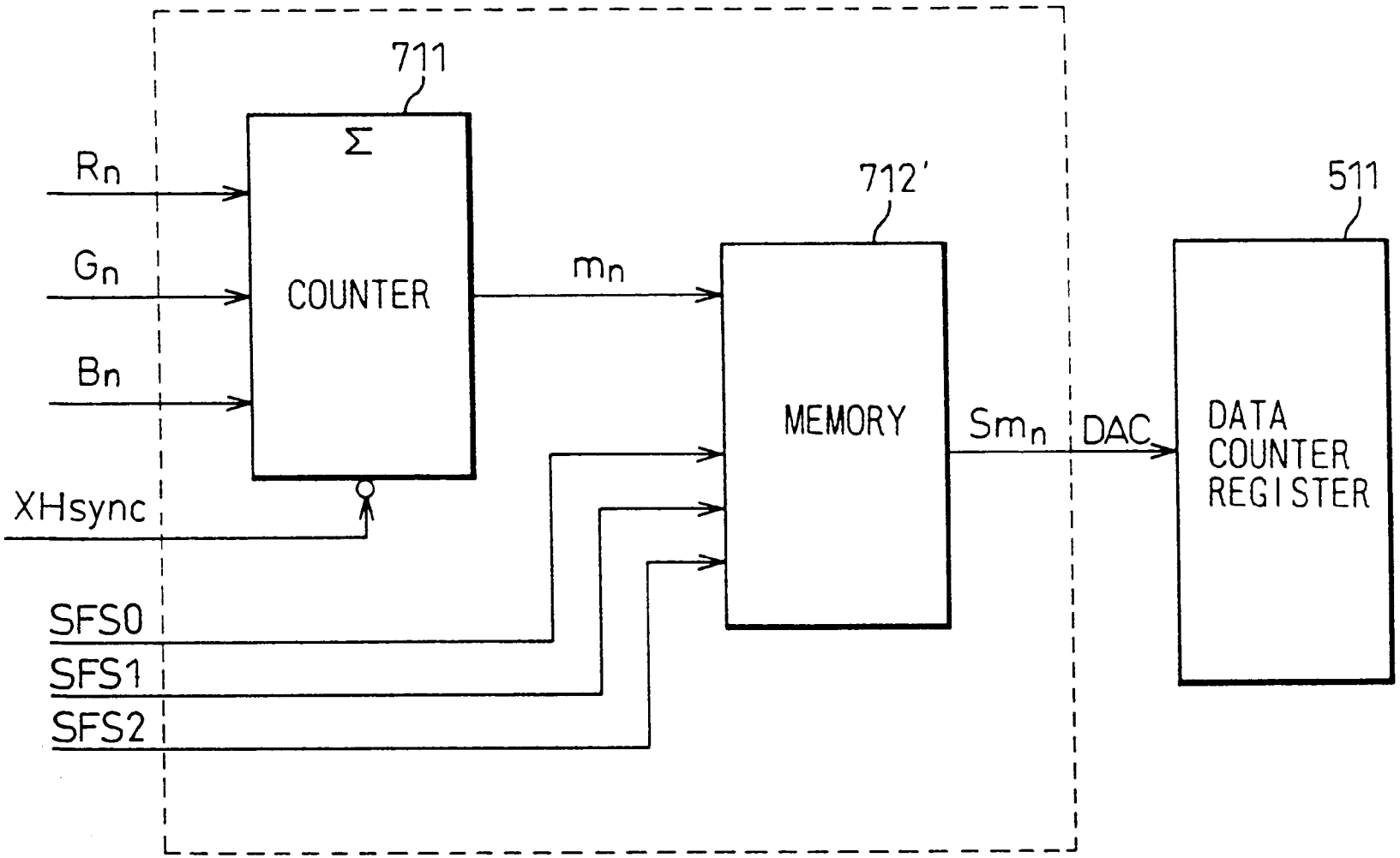
FIG. 17 is a circuit diagram showing another circuitry of the each line display data quantity counter in the first embodiment.

FIG. 17 is a circuit diagram showing another example of the circuitry of an each line display data quantity counter in this embodiment of the present invention. FIG. 17 shows another particular example of circuitry of the each line display data quantity counter 71 that is one of the components of this embodiment.

A counter 711 in FIG. 17 is identical to the counter in FIG. 16, and counts the number of bits as a quantity of display data to be set on each line during the n-th sub-frame. In this case, similarly to FIG. 16, a signal representing a count value and being output from the counter 711; that is, a display data quantity signal $m_n$ is a signal representing, for example, six high-order bits. Reference numeral 712' denotes a memory for storing a quantity of display data per line $m_n$ and data concerning a sustaining frequency associated with an input address represented by a signal SFS* (for example, SFS0, SFS1, or SFS2) indicating the state of a sub-frame.

In the each line display data quantity counter in FIG. 17, operations such as multiplication and addition, which are performed by an arithmetic unit shown in FIG. 16, are implemented in a program to be installed in the memory 712. A sustaining frequency $Sm_n$ output from the memory 712' is, similarly to that in FIG. 16, stored, for example, as an 8-bit display data quantity output data signal DAC in the data counter register 511. In other words, the each line display data quantity counter in FIG. 17 rereads on a software basis data concerning a quantity of display data stored in a PROM or RAM in the memory 712'. This enables simplification of circuitry.

Circuitries and operations have been described so far on the assumption that a picture display of the present invention is adapted to a triple-electrode surface-discharge AC type plasma display. The picture display of the present invention can be adapted not only to AC type plasma displays but also to a dual-electrode AC type plasma display, a DC type plasma display, and a liquid-crystal display.

Figure 18:
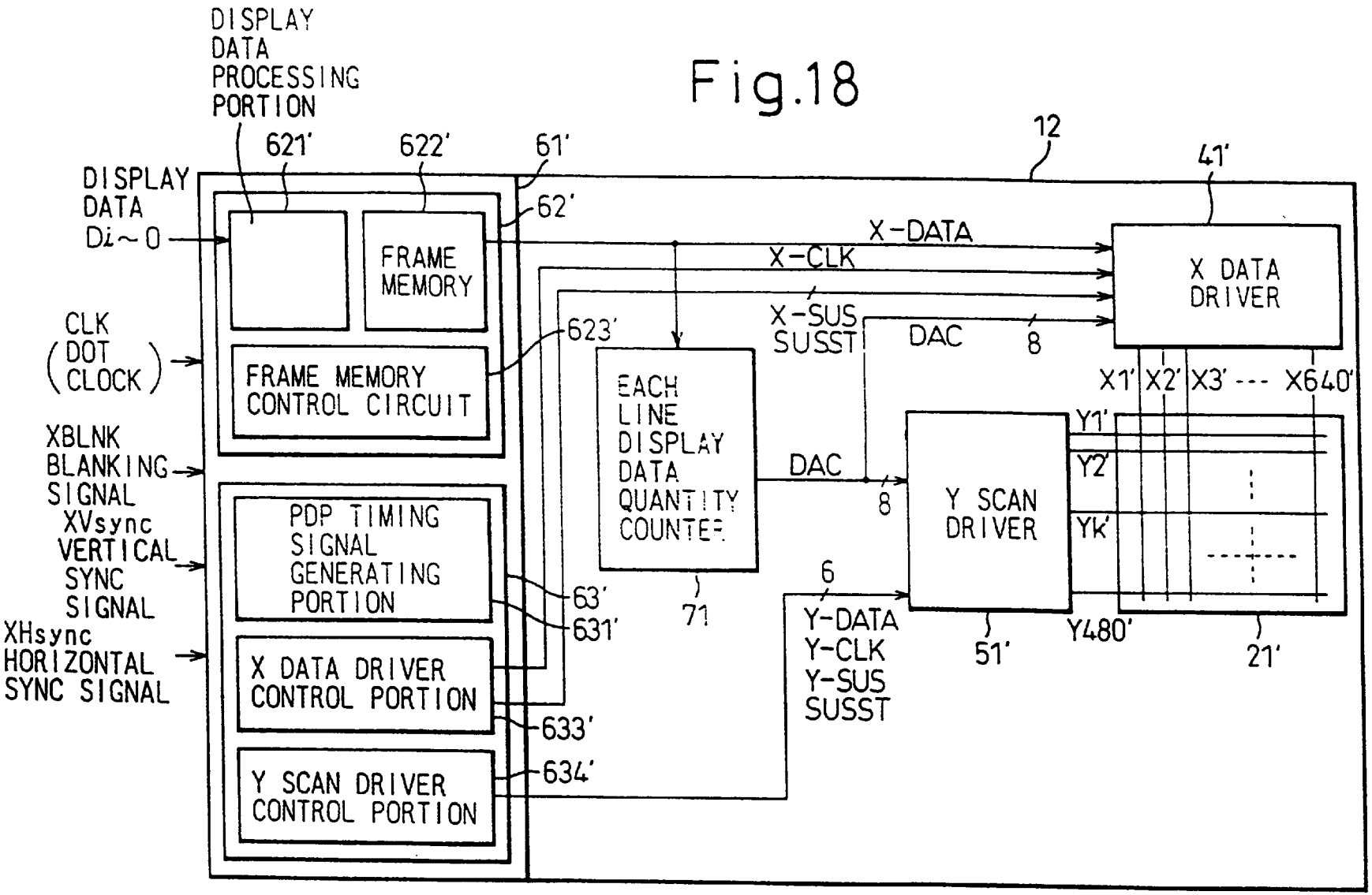
FIG. 18 is a block diagram showing the configuration of the second embodiment adapted to a dual-electrode plasma display.

FIG. 18 is a block diagram showing an example in which the present invention applies to a dual-electrode plasma display.

In a dual-electrode plasma display 12 shown in FIG. 18, unlike the aforesaid triple-electrode surface-discharge type plasma display, a plurality of display cells in a plasma display panel 21' are formed by two kinds of electrodes, for example, a plurality of address electrodes X1' to X640' serving as X electrodes and a plurality of sustaining electrodes Y1' to Yn' (where n denotes 480) serving as Y electrodes.

The plurality of display cells in the plasma display panel 21' are driven by two kinds of drivers; an X data driver 41' and a Y scan driver 51'. The former X data driver 41' executes driving of the plurality of address electrodes for the purpose of performing addressing discharge on selected display cells. The latter Y scan driver 51' executes driving of a sustaining electrode coincident with one line for the purpose of performing data scanning and sustaining discharge on the display cells.

In FIG. 18, a control circuit 61' is included to control all the operations of the dual-electrode plasma display 12 including the X data driver 41' and Y scan driver 51'. The major portion of the control circuit 61' includes a display data control portion 62' for controlling display data by performing addressing discharge on a plurality of display cells, and a drive timing control unit 63 for controlling the timing of driving the display cells in the plasma display panel 21' by means of the two kinds of drivers.

To be more specific, the display data control portion 62' includes a display data processing portion 621' for rearranging externally-input display data Di to D0 into data used to drive the dual-electrode plasma display 12, a frame memory 622' for temporarily storing 30 the rearranged display data Di to D0 and transferring the data consecutively to the X sustaining driver 41 in the form of a display data signal X-DATA used to control addressing discharge, and a frame memory control circuit 623' for reading or writing the frame memory 622' according to proper timing.

On the other hand, the drive timing control unit 63' includes a PDP timing signal generating portion 631' for converting various externally-input signals such as dot clock CLK, blanking signal XBLNK, vertical sync signal XVsync (sub-frame sync signal XSFsync), and horizontal sync signal XHxync into internal control signals used for display in the dual-electrode plasma display 12. The PDP timing signal generating portion 631' controls input display data, whereby a driving sequence to be followed by the X data driver 41' and Y scan driver 51' is determined.

The drive timing signal control unit 63' includes an X data driver control block 633' for transmitting control signals including a clock X-CLK used to control addressing discharge, a sustaining control signal X-SUS, and a sustaining control start signal SUSST to the X data driver 41'.

Furthermore, the drive timing signal control unit 63' includes a Y scan driver control block 634' for transmitting control signals including a scan data signal Y-DATA used to perform data scanning on the sustaining electrodes Y1' to Y480', a clock Y-CLK used for the data scanning, a sustaining control signal Y-SUS to be applied to the sustaining electrodes Y1' to Y480', and a sustaining start signal SUSST to the Y scan driver 51'.

Figure 19:
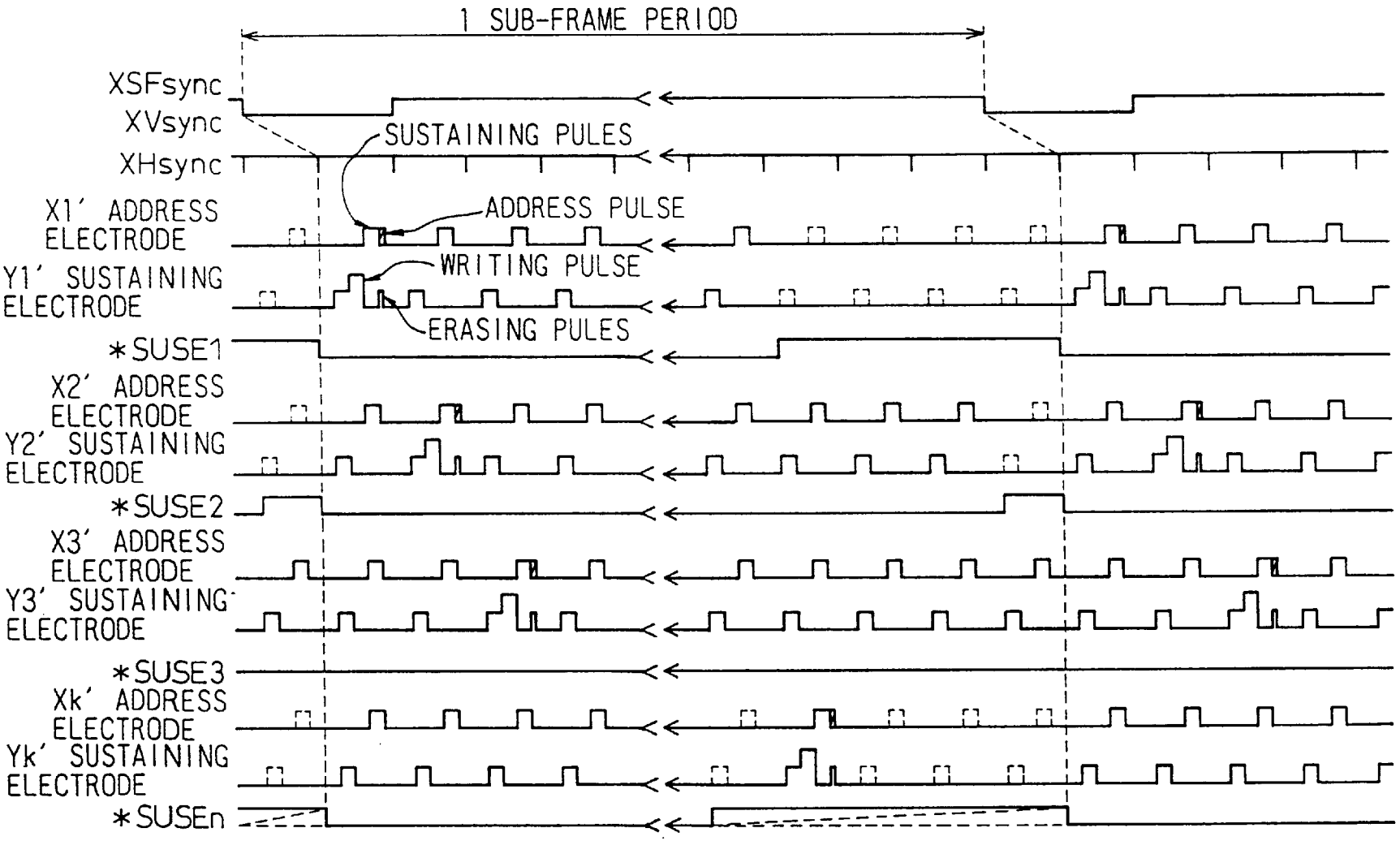
FIG. 19 is a timing chart showing waveforms of driving signals to be applied during one sub-frame in the second embodiment.

FIG. 19 is a timing chart showing waveforms of driving signals to be applied during one sub-frame in the dual-electrode plasma display shown in FIG. 18.

During one sub-frame shown in FIG. 19, the display cells connected to the plurality of address electrodes X1' to X640' serving as X electrodes are initialized, and then a writing pulse triggering writing discharge is applied to the sustaining electrodes Y1' to Y480' coincident with lines. An erasing pulse used to select some of display cells on each line is applied to the sustaining electrodes Y1' to Y480'. In response to the erasing pulse, an address pulse used to control addressing discharge is applied to the address electrodes X1' to X640'.

Furthermore, during the sub-frame, a sustaining pulse of a sustaining voltage that is lower than a writing voltage is applied to all the address electrodes X1' to X640'. At the same time, a sustaining pulse of the same voltage is applied to the sustaining electrodes Y1' to Y480' coincident with the lines. In other words, glowing discharge occurring in the selected display cells can be sustained by performing sustaining on the sustaining electrodes Y1' to Y480' coincident with the lines.

In FIG. 19, a frequency of generating a sustaining pulse is adjusted properly by means of the address electrodes X1' to X640' and enable signals *SUSE1 to *SUSEn (where n denotes 480) to be supplied to the sustaining electrodes Y1' to Y480' coincident with the lines. In the dual-electrode plasma display 12, the X data driver 41' has the capabilities of both the address data driver 31 and X sustaining driver 41 in FIG. 12.

Furthermore, the each line display data quantity counter 71 in FIG. 19 provides, similarly to the one in FIG. 12, a digital output of 8 bits long corresponding to a count that indicates a quantity of display data per line and that is represented by the display data X-DATA. The digital output; that is, a display data quantity output data signal DAC, is compared with the number of sustaining pulses counted in the X data driver 41' or Y scan driver 51'. Furthermore, the X data driver 41' and Y scan driver 51' perform driving on the basis of line-by-line enable signals *SUSE1 to *SUSE480 so that sustaining will continue until a count indicating a quantity of display data represented by the display data quantity output data signal DAC agrees with the number of sustaining pulses. Thus, in the dual-electrode plasma display shown in FIG. 19, similarly to the plasma display shown in FIG. 12, the number of sustaining pulses to be applied to a line having a large quantity of display data is made larger than the number of sustaining pulses to be applied to another line, whereby a difference in luminance between lines can be compensated for.

As described above, according to a display of the first mode of the present invention, display data to be displayed is detected for each line composed of a pair of a first electrode and a second electrode in, especially, a triple-electrode plasma display. Based on a result of counting the number of bits as a quantity of display data, a frequency of sustaining discharge performed by the first and second electrodes is set. Thus, the frequency of sustaining discharge is adjusted properly. For a line on which a luminance decrease has occurred because the quantity of display data corresponding to a load to be imposed on the line is large, the frequency of sustaining discharge is increased. Thus, a difference in luminance of the line from a line having a small quantity of display data can be compensated for. Eventually, a uniform luminance can be attained over all the lines in a display panel.

Furthermore, a result of counting pulses of a sustaining discharge control signal applied to each line composed of a pair of a first electrode and second electrode is compared with a result of counting the number of bits as a quantity of display data per line. Based on an enable signal produced when both the results of counting agree with each other, the number of sustaining pulses used for sustaining discharge and applied to each line is controlled. Consequently, the number of sustaining pulses to be applied to a line having a small quantity of display data can be decreased using a simple control circuit. A luminance difference deriving from a difference in quantity of display data between different lines can be made nil.

Furthermore, a sustaining discharge control signal counter, agreement judging circuits for judging if it is detected that a result of counting pulses of a sustaining discharge control signal agrees with a result of counting the number of bits as a quantity of display data per line, enable signal producing units for producing an enable signal at the time when both the results agree with each other, and logic circuits for performing the logic operation handling an enable signal and sustaining discharge control signal are incorporated in at least one of a first electrode driver and second electrode driver for driving first electrodes and second electrodes respectively. When the drivers are integrated into one, it becomes possible to readily realize a compact driver having the ability to set line by line the number of sustaining pulses according to a quantity of display data and to compensate for a luminance difference deriving from a difference in quantity of display data between lines.

Furthermore, a plurality of high-voltage output stages for driving a digital signal corresponding to display data of a plurality of bits long, and a data counter register that holds data concerning a quantity of display data to be set on a line, which has been scanned in advance, so that sustaining discharge can be performed by a frequency of sustaining discharge indicated by a sustaining discharge control signal at a time relative to each bit of a digital signal during a sustaining period for sustaining discharge are incorporated in at least one of the first electrode driver and second electrode driver. Even when a total quantity of display data is large, a digital signal a plurality of bits long can be driven at one time. Consequently, a luminance difference deriving from a difference in quantity of display data between lines on a large screen can be compensated for quickly.

Furthermore, in either of the first electrode driver or second electrode driver, a supply voltage used for scanning control and a supply voltage used for sustaining discharge control are supplied over a common power line and switched by a switching circuit. Thus, only one driver performs both the driving of display cells for scanning control and the driving thereof for sustaining discharge control. A luminance difference deriving from a difference in quantity of display data between lines can be compensated for correctly without the necessity of complex power circuitry.

In short, in a picture display of the present invention, even if display information has display data distributed unevenly within a certain sub-frame or between different sub-frames, a quantity of display data per line is detected, and a frequency of sustaining discharge is adjusted properly line by line in order to compensate for a decrease in luminance of a line having a large quantity of display data. Owing to this compensation for a luminance decrease, a luminance difference between lines occurring during a sub-frame can be compensated for. Besides, unbalance or discontinuity of gray scale between different sub-frames can be corrected so that gray scale will have linearity. Consequently, multilevel gray-scale display independent of a quantity of display data can be achieved. This contributes to improvement of performance of a color display or, especially, a triple-electrode plasma display.

In the first and second embodiments, a luminance decrease dependent on a quantity of display data is corrected for each display line. The luminance decrease dependent on a quantity of display data poses a problem of gray-scale inversion between sub-frames. Next, an embodiment in which a luminance decrease dependent on a quantity of display data is corrected between sub-frames will be described.

Figure 20:
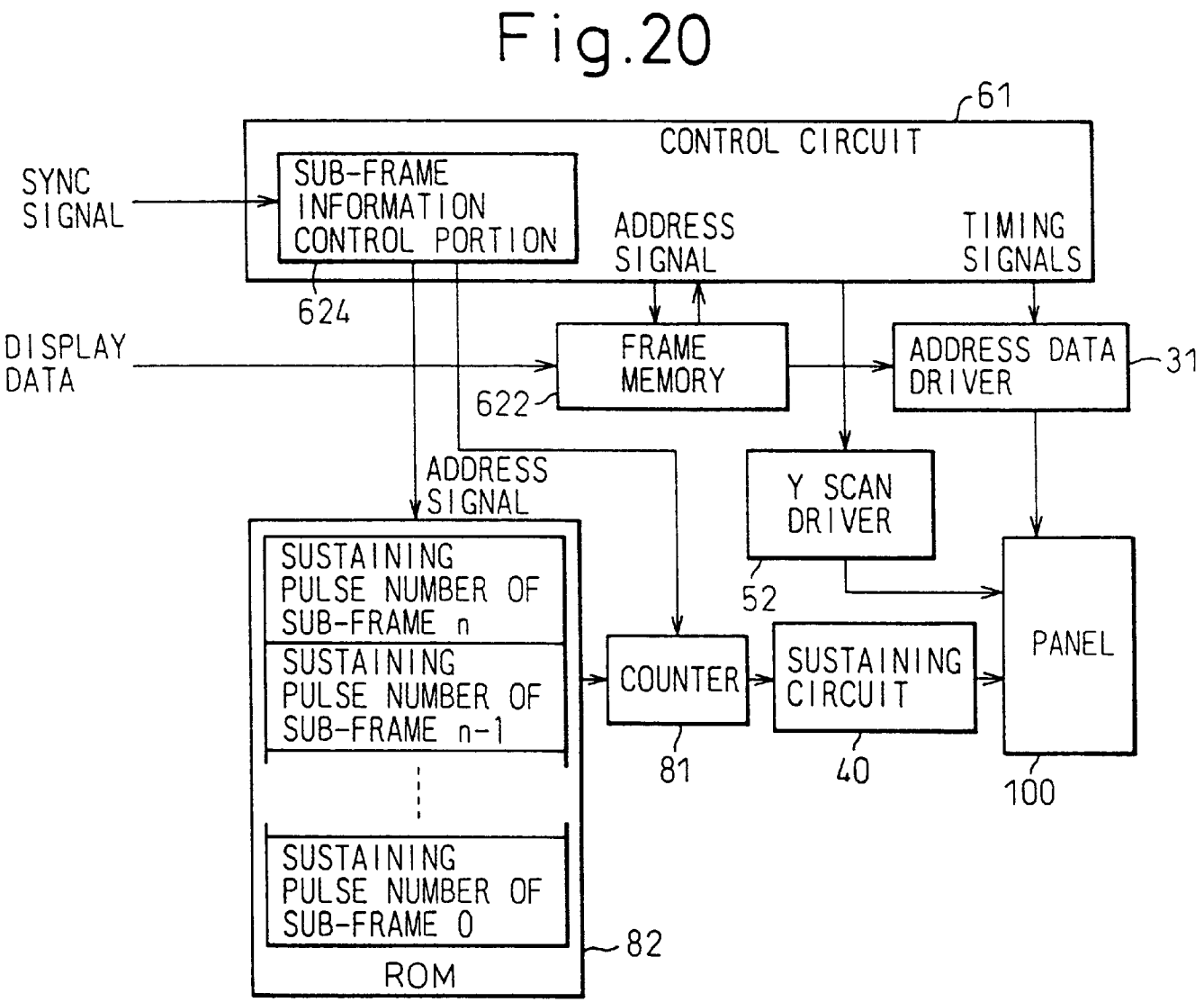
FIG. 20 is a diagram showing the configuration of a known PD having a sustaining pulse ROM.

FIG. 20 is a block diagram showing in detail a portion of the configuration of the known plasma display relating to sustaining discharge. The Y common driver 53 and X common driver 41 are above all involved in sustaining discharge. Herein, the Y common driver 53 and X common driver 41 are depicted as a sustaining circuit 40. The frame memory 622 is depicted as an external unit of the control circuit 61.

As shown in FIG. 20, a sub-frame information control portion 624 is included in the control circuit 61. A ROM 82 for storing a frequency of sustaining discharge to be performed during each sub-frame; that is, the number of sustaining pulses is included.

In the ROM 82, the numbers of sustaining discharge pulses (sustaining pulses) are stored in one-to-one relation to sustaining discharge periods within sub-frames. The sub-frame information control portion 624 included in the control circuit 61 identifies a sub-frame in response to a sync signal, reads the associated number of sustaining pulses, and sets the number of sustaining pulses in a counter 81. The counter 81 inputs a sustaining pulse produced by the sub-frame information control portion 624 and counts it by the set number of sustaining pulses. The counter 81 outputs an input sustaining pulse to the sustaining circuit 40 until it completes counting the set number of sustaining pulses. The sustaining circuit 40 then applies a sustaining pulse to a panel 100. Thus, sustaining discharge is performed during a sustaining period within a sub-frame.

Figure 22:
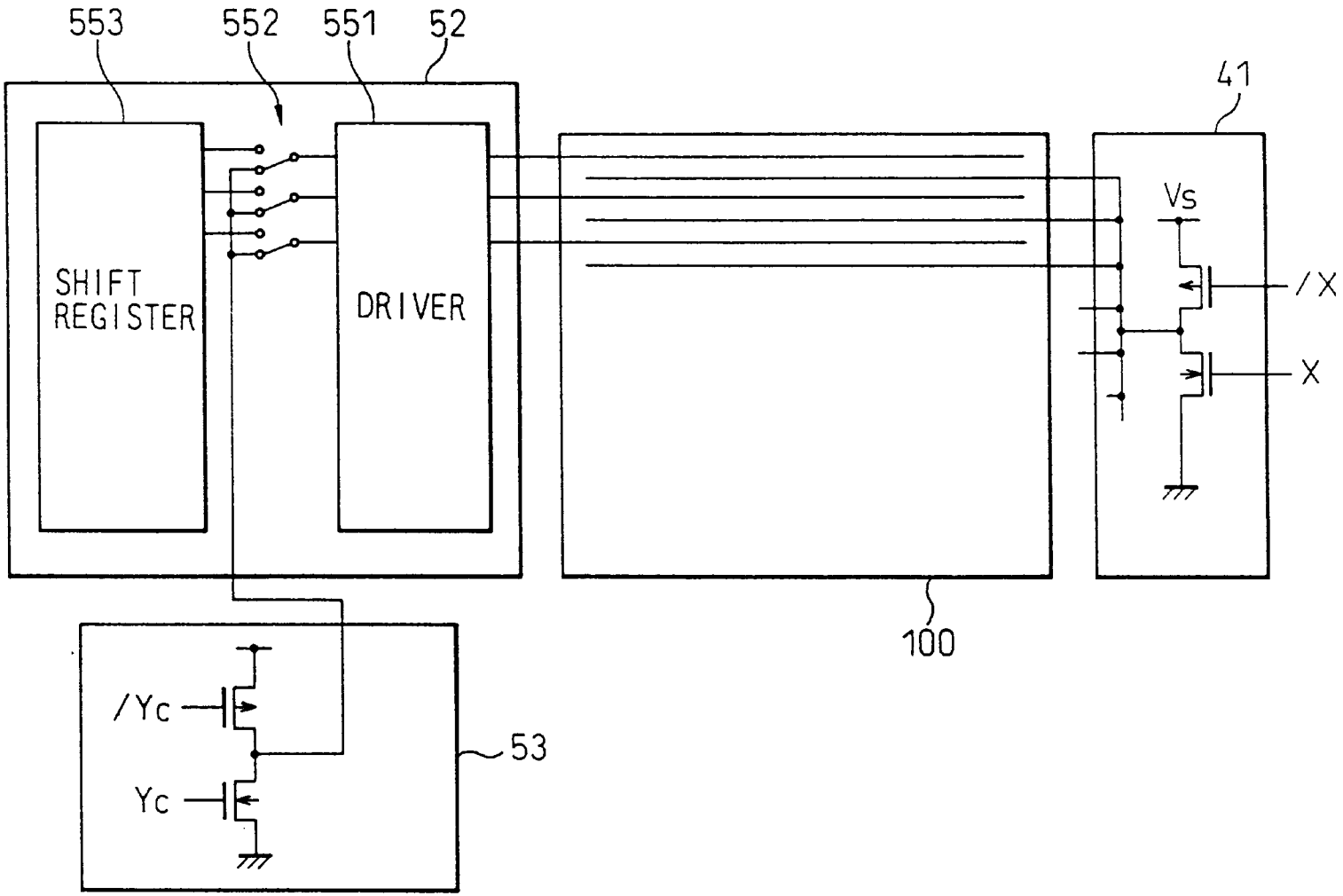
FIG. 22 is a diagram showing the configuration of a common driver in the known panel display.

FIG. 22 is a diagram showing in more detail the Y common driver 53 and X common driver 41 incorporated in the sustaining circuit as well as the Y scan driver 52. In the Y scan driver 52, during addressing discharge, a switch array 552 is connected to a shift register 553, and a shift pulse output from the shift register 553 is applied as a Y scan pulse to the Y electrodes via a driver 551. During sustaining discharge, the switch array 552 is switched over to the Y common driver 53, and a sustaining pulse output from the Y common driver 53 is applied in common to the X electrodes via the driver 52. During sustaining discharge, a sustaining pulse whose phase is opposite to that of a sustaining pulse sent from the Y common driver 53 is supplied from the X common driver 41.

As shown in FIG. 22, a sustaining pulse is applied from the Y common driver 53 and X common driver 41, concurrently, to the Y electrodes and X electrodes respectively. A current to be driven by the Y common driver 53 and X common driver 41 varies depending on the number of cells on the whole surface to be subjected to sustaining discharge; that is, a display load. When a current varies, a magnitude of a voltage drop varies because of the influences of output impedances of circuits and impedances of lines. This causes the voltage of a sustaining pulse to vary. Eventually, a luminance attained by sustaining discharge fluctuates.

Figure 23:
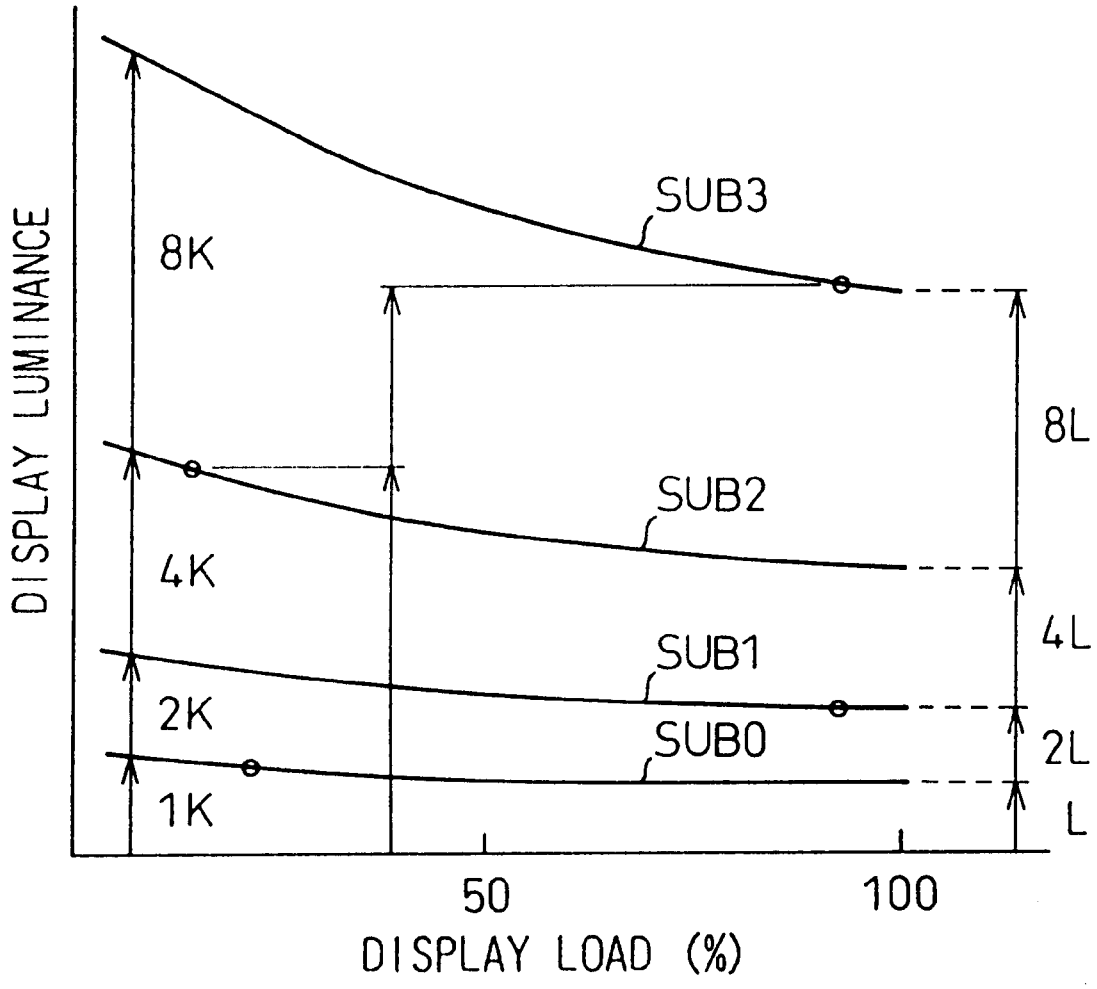
FIG. 23 is a graph showing variations of display brightnesses to be attained during sub-frames relative to display loads.

FIG. 23 is a diagram showing a change in effective display brightness dependent on a display load during each sub-frame. Herein, the number of sub-frames is four.

An effective display brightness permitted during each sub-frame is determined by a luminance attained by sustaining discharge and a sustaining discharge period. As described in FIG. 5, the sustaining discharge periods within the sub-frames demonstrate a given ratio. As long as a display load per sub-frame is the same, a luminance attained by sustaining discharge is the same. Display brightnesses attained during the sub-frames have the same ratio as the sustaining discharge periods within the sub-frames. However, as shown in FIG. 23, when a display load per sub-frame becomes different, a luminance attained by sustaining discharge differs from sub-frame to sub-frame. The display brightnesses attained during the sub-frames do not have the given ratio. When this event occurs, gray scale rendered by combining the sub-frames is not precise. At worst, there arises a problem that brightnesses are inverted between gray levels.

Figure 24:
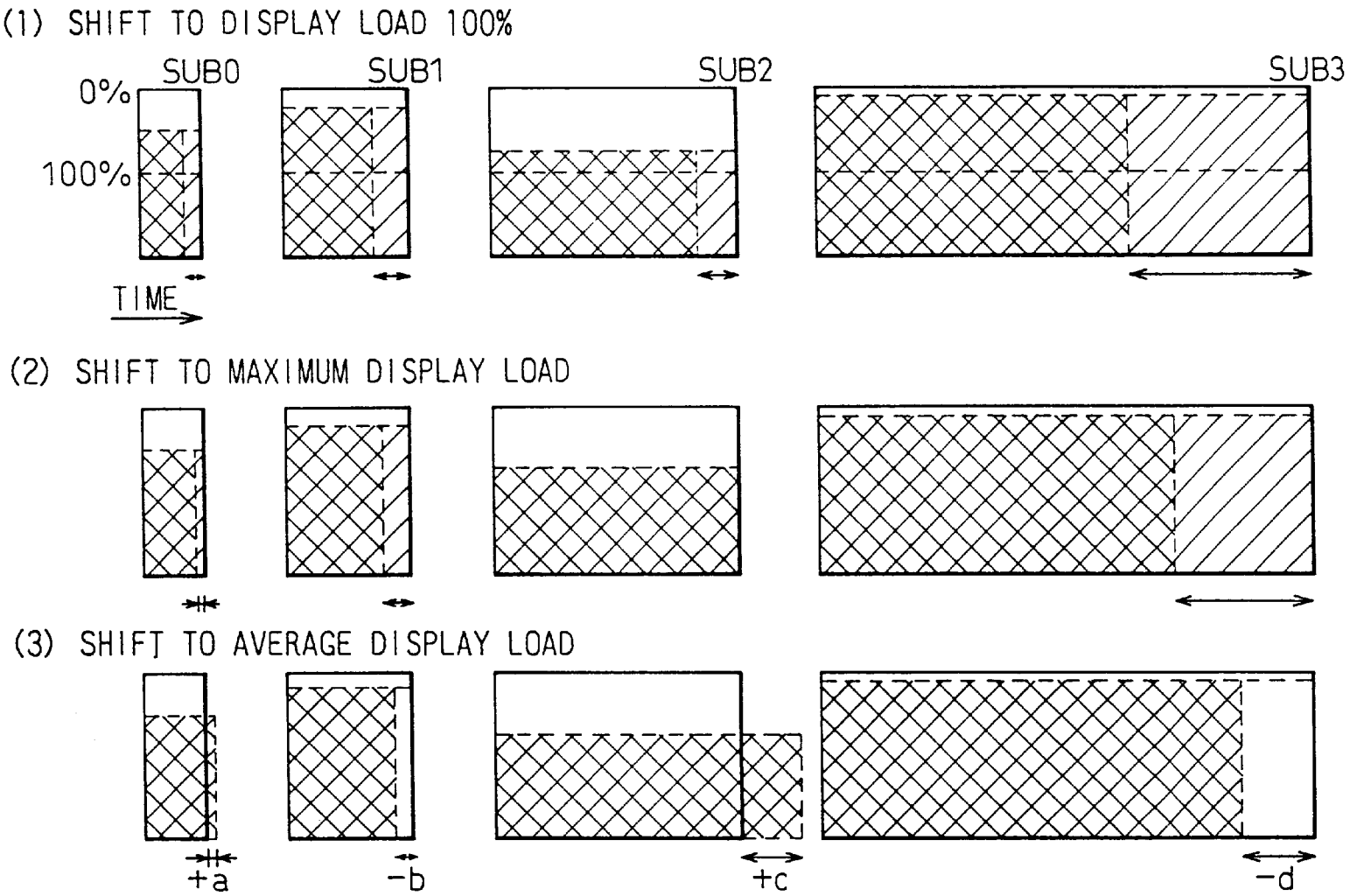
FIG. 24 is a diagram for explaining the principles of correction in the second mode of the present invention.

FIG. 24 is a diagram for explaining the principles of correction in the second mode of the present invention.

In FIG. 24, the axis of abscissae indicates time and the axis of ordinates indicates luminance provided by a display glowing means. The luminance varies as illustrated with display loads that are 0% to 100% of a full load. A brightness is expressed as a product of a luminance by a time. As illustrated, a brightness attained during a sub-frame having a longer display glowing period is higher.

FIG. 24(1) shows the correction for adjusting the length of a display glowing period so that a brightness to be attained during each sub-frame will be matched with a brightness attained when a display load is 100% of a full load. During each sub-frame, a luminance is determined with a display load. An inverse number of the ratio of the luminance to a luminance permitted by a display load of 100% of a full load is used as the multiplier of a display glowing period within each sub-frame. Thus, a corrected period is determined. A crosshatched area in the drawing indicates a brightness attained during a corrected period. The brightness will have the same value as a product of the luminance permitted by a display load of 100% of a full load by a display glowing period within each sub-frame. A corrected display glowing period within each sub-frame is shorter by a time indicated with arrows. When a display glowing period is shortened by a time indicated with arrows, it means that it gets darker than it does when glowing is effected during a full display glowing period. In this kind of display, it is required to improve display brightness. Correction in which display brightness is improved with a brightness ratio between sub-frames held intact is shown in FIGS. 24(2) and 24(3).

FIG. 24(2) shows correction in which, while a display load is being imposed during each sub-frame, a display glowing period is adjusted in order to attain a brightness permitted by a maximum display load. In the drawing, the maximum display load is imposed during the third sub-frame 2 (SUB2). A display glowing period within any other sub-frame is adjusted in order to attain a brightness level permitted by the display load imposed during the SUB2. As for the SUB2, glowing is effected during an originally-defined display glowing period within the SUB2. Consequently, a corrected display glowing period becomes longer than that shown in FIG. 24(1). However, it cannot be said that an originally-defined display glowing period is utilized effectively. In FIG. 24(3), the display brightness is further improved.

In FIG. 24(3), a weighted mean is calculated by weighting a display load to be imposed during each sub-frame using a ratio of a display glowing period to the sub-frame. The display glowing period within each sub-frame is then adjusted in order to attain a brightness permitted by the display load of the weighted mean. A corrected display glowing period within the SUB2 during which a large display load is imposed gets longer than an originally-defined display glowing period. By contrast, a corrected display glowing period within a sub-frame during which a small display load is imposed gets shorter than an originally-defined display glowing period. Since a brightness to be attained during each sub-frame is matched with a brightness permitted by a display load of a weighted mean, a total of corrected display glowing periods within sub-frames equals to a total of originally-defined display glowing periods of the sub-frames.

Figure 25:
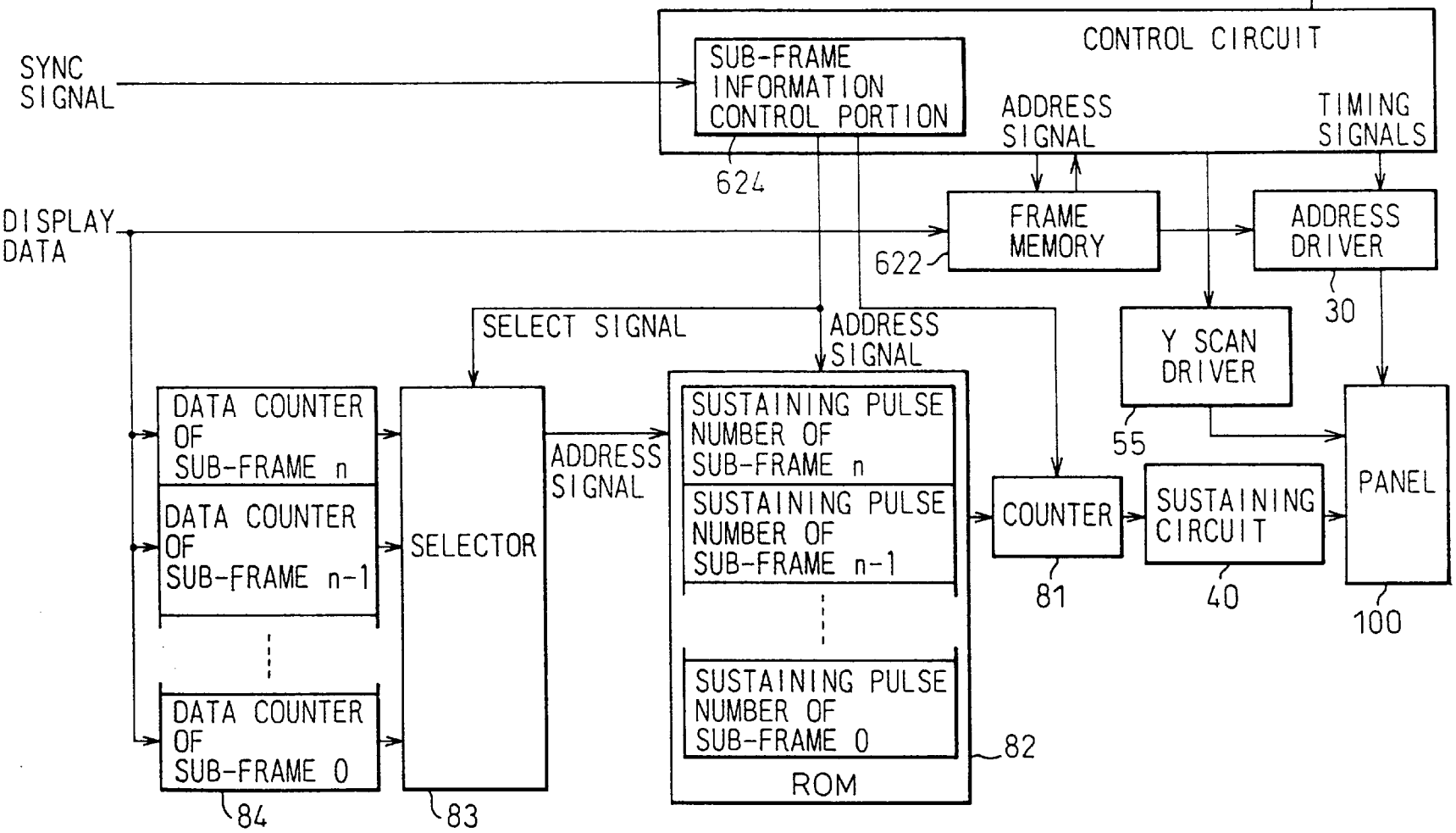
FIG. 25 is a diagram showing the overall configuration of a PDP of the third embodiment.

FIG. 25 is a diagram showing the configuration of a triple-electrode surface-discharge AC type plasma display (PD) of the third embodiment of the present invention. As apparent from the comparison of FIG. 25 with FIG. 20, the third embodiment has a configuration analogous to that of the known plasma display. Only the difference from the known plasma display will be described below.

In the third embodiment, a selector 83 and counters 84 are newly included. The number of the counters 84 is equivalent to the number of sub-frames. Each counter counts the number of cells to be subjected to sustaining discharge during each sub-frame, converts a ratio of the count value to the number of all cells on the whole surface into bit data indicating a display load, and then outputs the bit data. For example, when a ratio of the number of cells to be enabled to glow for display during a certain sub-frame to the number of all cells is 40%, it is converted into a hexadecimal number 1H. A ratio 60% is converted into 2H.

FIG. 26 is a table showing the contents of data stored in a ROM 82 in which the numbers of sustaining pulses to be applied during sub-frames are stored. As illustrated, the corrected numbers of sustaining pulses providing the same display brightness as a brightness permitted by a display load of 100% of a full load are stored in one-to-one relation to a plurality of display loads relative to sub-frames. Taking sub-frame 0 (SUB0) for instance, when a display load is 100% of a full load, 16 sustaining pulses are needed. When the display load is 40% thereof, 11 corrective sustaining pulses are needed to attain the same brightness as that permitted by the display load of 100%. 11 is therefore stored in relation to the display load of 40%. A signal sent from the selector 83 is applied as a low-order bit of an address in the ROM 82. A signal sent from the sub-frame information control portion 624 is applied as a high-order bit thereof.

As for display data supplied externally, data representing gray levels of respective cells and consisting of n+1 bits is supplied continually (as for color data, three sets of this kind of data are supplied concurrently). The data cannot be converted into sub-frame data as it is. The data is therefore temporarily stored in the frame memory 622, delayed by one frame, supplied to the address driver 30 in the form of sub-frame data conformable to the PD, and then displayed. The display data is also supplied to the counters 84. While being stored in the frame memory 622, bits of the display data enabling associated cells to glow are counted relative to each bit representing a gray level. When display data for one frame is stored in the frame memory 622, the counters 84 stop counting. A total number of bits of data enabling associated cells to glow and being counted relative to respective gray-level bits; that is, a total number of cells glowing during respective sub-frames is calculated. Synchronously with the start of the next frame, the first sub-frame shown in FIG. 5 starts. During an addressing period succeeding a rest period, data associated with a bit corresponding to the sub-frame is read from the frame memory 622, and applied to the address electrodes by the address driver 30. The respective cells thus enter states represented by the display data allotted to the sub-frame. Next, sustaining discharge is started. At this time, the sub-frame information control portion 624 outputs a select signal associated with the sub-frame to a ROM 110 and selector 111. In response to the select signal, the selector 111 selects one of outputs of the counters 82 associated with the sub-frame; that is, bit data representing a display load to be imposed during the sub-frame, and applies the bit data as a low-order bit of an address in the ROM 82. A select signal associated with the sub-frame has already been applied as a high-order bit of the address in the ROM 82 by the sub-frame information control portion 624. The corrected number of sustaining pulses, which permits the same brightness as a brightness permitted by a display load of 100% of a full load even when discharge glowing is executed with a calculated display load during the sub-frame, is then read out from an associated sub-frame area in the ROM 82, and then output to the counter 81. The counter 81 controls the sustaining circuit so that sustaining discharge will be executed by the number of times corresponding to the number of sustaining pulses. The same applies to the subsequent sub-frame. The corrected number of sustaining pulses is selected from the ROM 82 according to data of a total number of cells that is counted by an associated counter 84 and to be enabled to glow for display. Sustaining discharge is then executed by the number of times corresponding to the number of sustaining pulses. In the meantime, display data for the next frame must be stored in the frame memory 622. The counters 84 each must count the number of cells enabled to glow during an associated sub-frame. Two frame memories and two groups of counters having the same configurations are therefore needed and must be used alternately. However, when a latch for latching a value at the time of completion of counting and which retains the value during one frame is included in each of the counters 84, one group of the counters will do.

Figure 27:
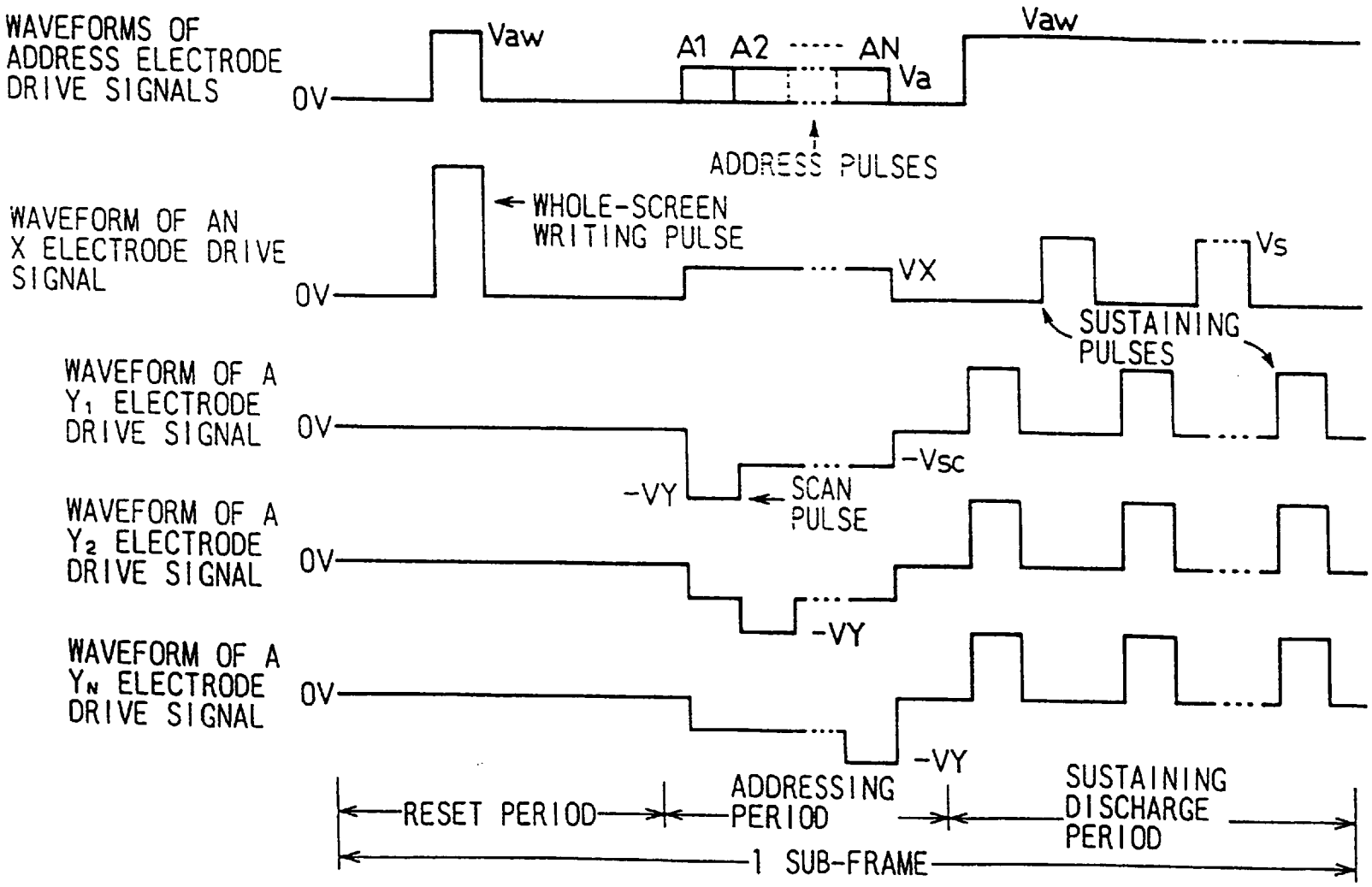
FIG. 27 is a table showing data in a sustaining pulse ROM in the third embodiment.

FIG. 27 is a timing chart showing waveforms of driving signals to be applied during one sub-frame in the third embodiment and thereafter. As is apparent from a comparison with FIG. 6, the waveforms are substantially the same as those in FIG. 6. The differences are that a positive pulse of an address electrode driving signal is applied in response to an erasing pulse at the first step 1 within an addressing period (reset period), and that the scanning pulse is negative. The driving signals having the waveforms shown in FIGS. 6 and 27 have been used in the past and do not have direct relation to the purport of the present invention. A more detailed description will therefore be omitted.

Figure 28:
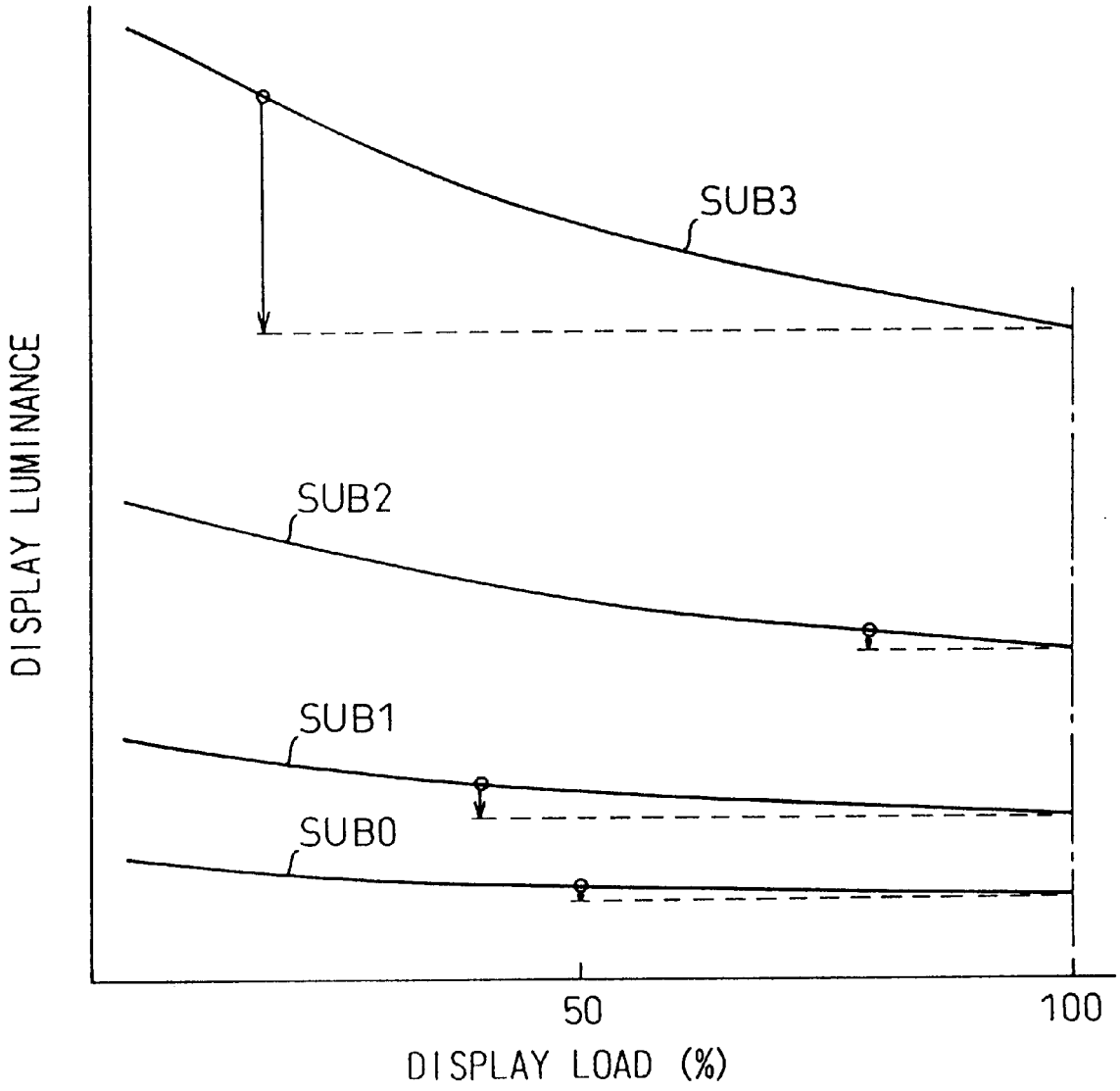
FIG. 28 is a graph for explaining correction in the third embodiment.

FIG. 28 is a graph for explaining a method of correction employed in the third embodiment.

In FIG. 28, a circle denotes a brightness attained when cells glow for a period of time corresponding to an originally-determined number of sustaining pulses during each sub-frame. A brightness to be attained during each sub-frame is adjusted by decreasing the number of sustaining pulses, so that the brightness will be matched with a brightness permitted by a display load of 100% of a full load.

Figure 29:
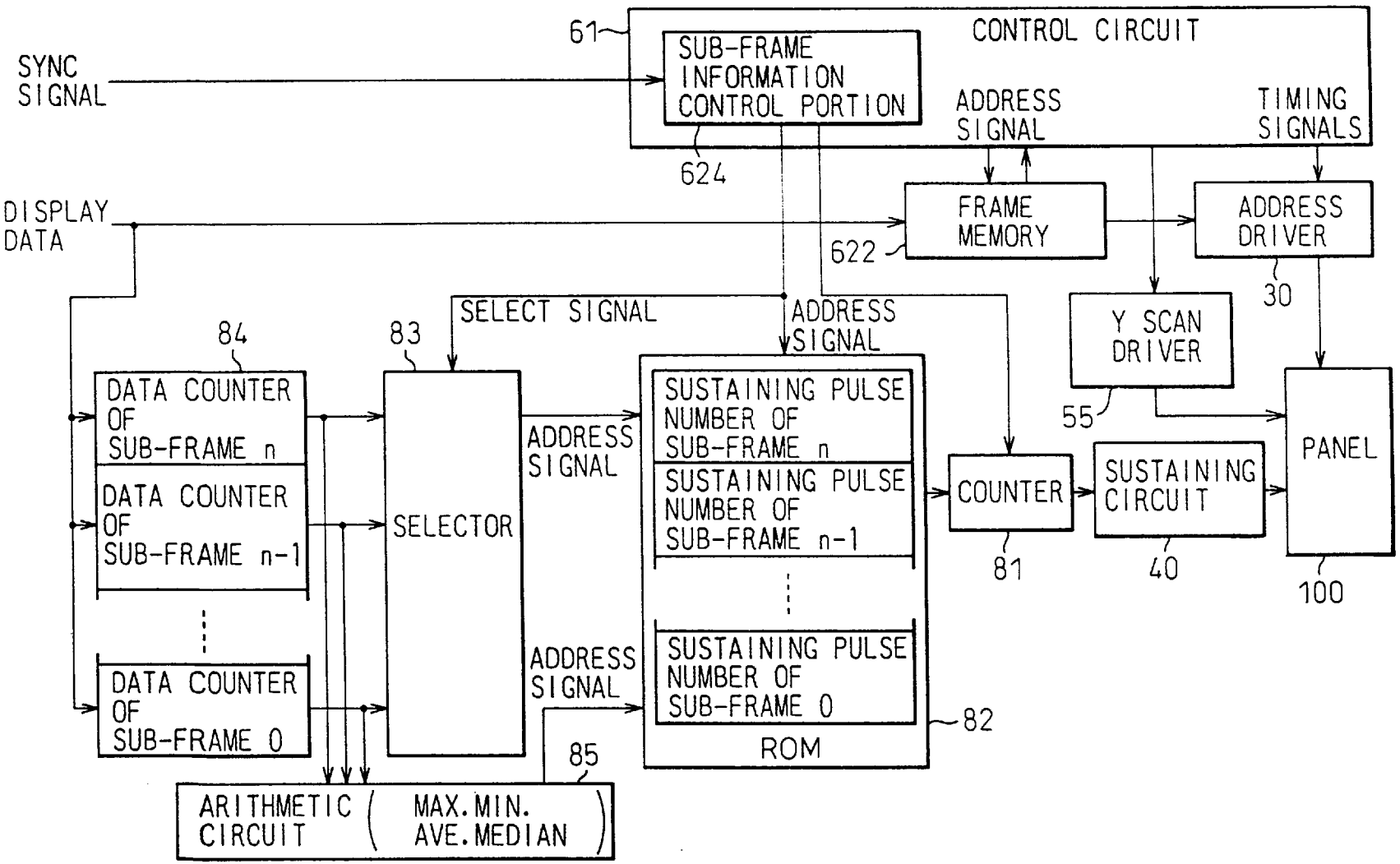
FIG. 29 is a diagram showing the overall configuration of a PDP of the fourth embodiment.

FIG. 29 is a diagram showing the configuration of a PD of the fourth embodiment. As apparent from the comparison with FIG. 25, a difference from the third embodiment lies in that an arithmetic circuit 85 is included. Moreover, the contents of the ROM 82 are different.

The arithmetic circuit 85 performs the operation for seeking a maximum one of the numbers of cells enabled to glow during respective sub-frames and counted by the counters 84.

FIG. 30 is a table showing the contents of data stored in the ROM 82. As illustrated, a plurality of corrected numbers of sustaining pulses permitting the same brightnesses as those permitted by various kinds of maximum loads are stored in one-to-one relation to a plurality of display loads relative to sub-frames.

Taking sub-frame 0 (SUB0) for instance, the numbers of sustaining pulses permitting the same brightnesses as those permitted by display loads of 100%, 80%, 60%, 40%, and 20% of a full load are stored in one-to-one relation to the display loads of 100%, 80%, 60%, 40%, and 20%. As far as sub-frame 0 is concerned, for example, when a brightness to be attained is matched with a brightness permitted by a maximum display load of 80% of a full load, if a display load is 80% thereof, the number of sustaining pulses is 16. If a display load is 60% thereof, the number of sustaining pulses is 14. If a display load is 40% thereof, the number of sustaining pulses is 12. These data is stored in the ROM 82. A signal sent from the selector 83 is applied as a low-order bit of an address in the ROM 82. An output of the arithmetic circuit 85 is applied as a middle-order bit thereof. A signal sent from the sub-frame information control portion 624 is applied as a high-order bit thereof.

Figure 31:
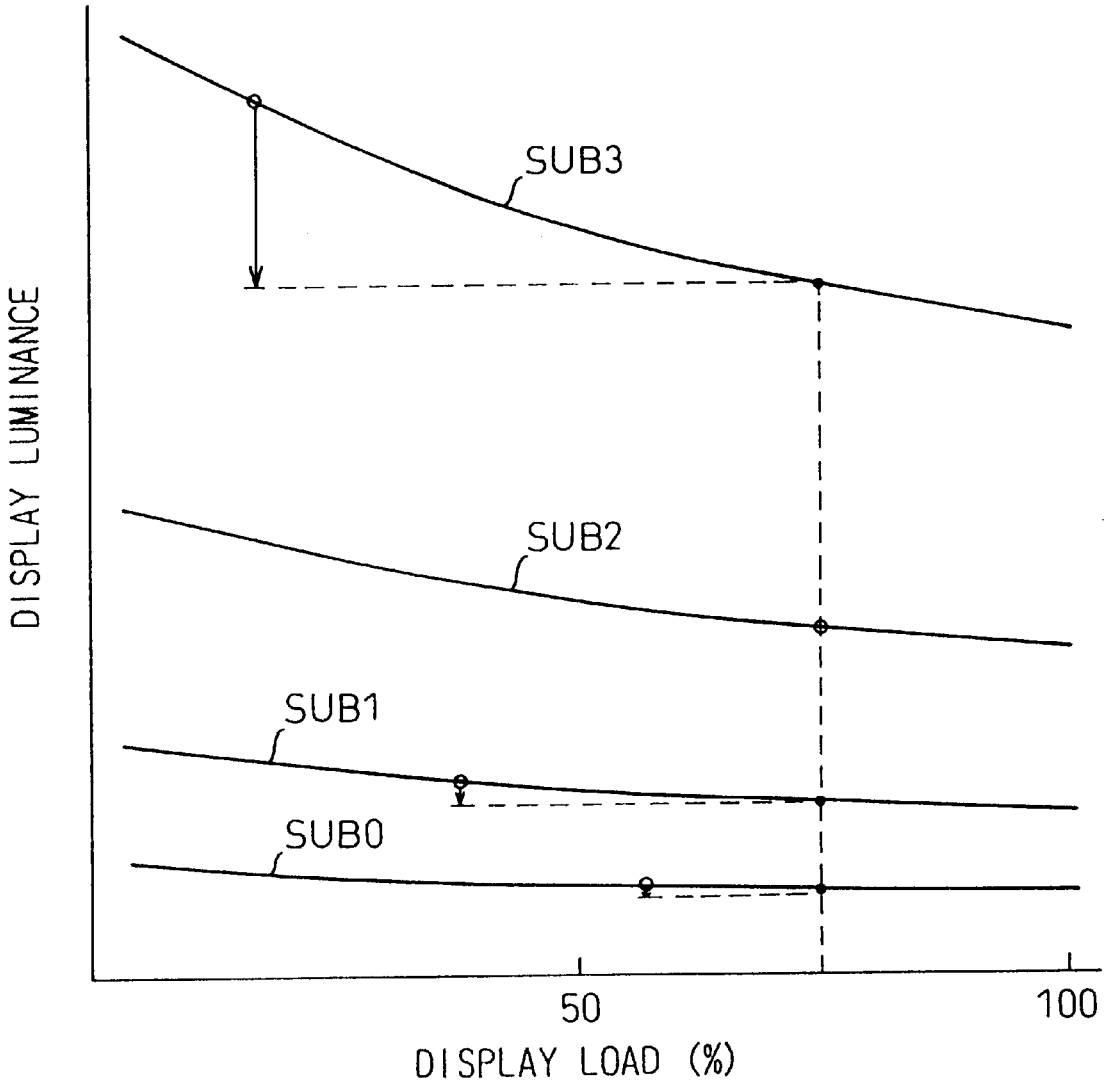
FIG. 31 is a graph for explaining correction in the fourth embodiment.

FIG. 31 is a graph showing a method of correction employed in the fourth embodiment.

In FIG. 31, a display load to be imposed during sub-frame 2 (SUB2) is the largest. During SUB2, sustaining discharge is effected for an originally-defined sustaining period. During any other sub-frame, the length of a sustaining period is adjusted according to a display load to be imposed during the sub-frame so that a brightness will be matched with a brightness attained when cells are enabled to glow with the display load to be imposed during SUB2 for the originally-defined sustaining period during SUB2.

Similarly to the third embodiment, the sub-frame information control portion 624 outputs a select signal associated with a sub-frame as a high-order bit of an address to the ROM 82, and also outputs the select signal to the selector 83. In response to the select signal, the selector 83 converts an output of one of the counters 84 associated with the sub-frame into bit data representing a display load, and applies the bit data as a low-order bit of the address to the ROM 82. Furthermore, the arithmetic circuit 85 converts a maximum one of the numbers of cells enabled to glow during respective sub-frames into bit data representing a display load, and applies the bit data as a middle-order bit of the address to the ROM 82. In the ROM 82, a sub-frame is selected according to the select signal sent from the sub-frame information control portion 624, a maximum display load is identified according to the signal sent from the arithmetic circuit 85, and a display load to be imposed during the sub-frame is identified according to the signal sent from the selector 83. Taking sub-frame 0 for instance, a range from address *000 to *044 is selected. If a maximum display load to be imposed during sub-frame 2 is 80% of a full load, a range from address *030 to *034 is selected. If a display load to be imposed during sub-frame 0 is 60% of the full load, address *032 is finally selected.

Consequently, the corrected number of sustaining pulses is read out, which number matches a brightness to be attained by imposing a display load of 60% of a full load during sub-frame 0 with a brightness attained by imposing a display load of 80% of a full load during sub-frame 2, is 14. The number of sustaining pulses is then output to the counter 81.

In the fourth embodiment, the arithmetic circuit 85 is used to calculate a maximum one of display loads to be imposed during sub-frames. The number of sustaining pulses is adjusted so that a brightness to be attained will be matched with a brightness permitted by the maximum one of display loads to be imposed during sub-frames. Alternatively, a brightness to be attained may be matched with a brightness permitted by a minimum one of display loads to be imposed during sub-frames, by a display load of a weighted mean thereof, or by a display load of a median thereof. In this case, the arithmetic circuit 85 should merely be changed to one for calculating a minimum one of display loads to be imposed during sub-frames, a display load of a weighted mean thereof, or a display load of a median thereof.

However, when a brightness is matched with the one attained when cells are enabled to glow with a minimum one of display loads to be imposed during sub-frames or a display load of a median thereof, a total sum of the corrected numbers of sustaining pulses may exceed a total sum of the original numbers of sustaining pulses. In this case, the length of one frame exceeds a given length and synchronism with an external signal cannot be attained. When synchronism with an external signal is attained forcibly, the display may not be executed during part of the last sub-frame or some sub-frames. A limiter for limiting a total sum of the corrected numbers of sustaining pulses is therefore included. If a total sum of the corrected numbers of sustaining pulses exceeds a total sum of the original numbers of sustaining pulses, the corrected numbers of sustaining pulses to be applied during respective sub-frames are decreased uniformly at a ratio of the total sum of the original numbers of sustaining pulses to the total sum of the corrected numbers of sustaining pulses.

For calculating a weighted mean of display loads, the display loads to be imposed during sub-frames are weighted, added up, and then divided by a sum of weights. In reality, since a weight ratio between sub-frames is the factorial of 2, after each of binary numbers is shifted by one bit, the binary numbers are added up. Thus, the sum of weights can be calculated readily. As for division, assuming that the number of sub-frames is n, 1 is subtracted from the n-th power of 2. The n-th power of 2 is regarded as an approximate value, and bit shift is carried out downward. Thus, division can be performed readily.

Figure 32:
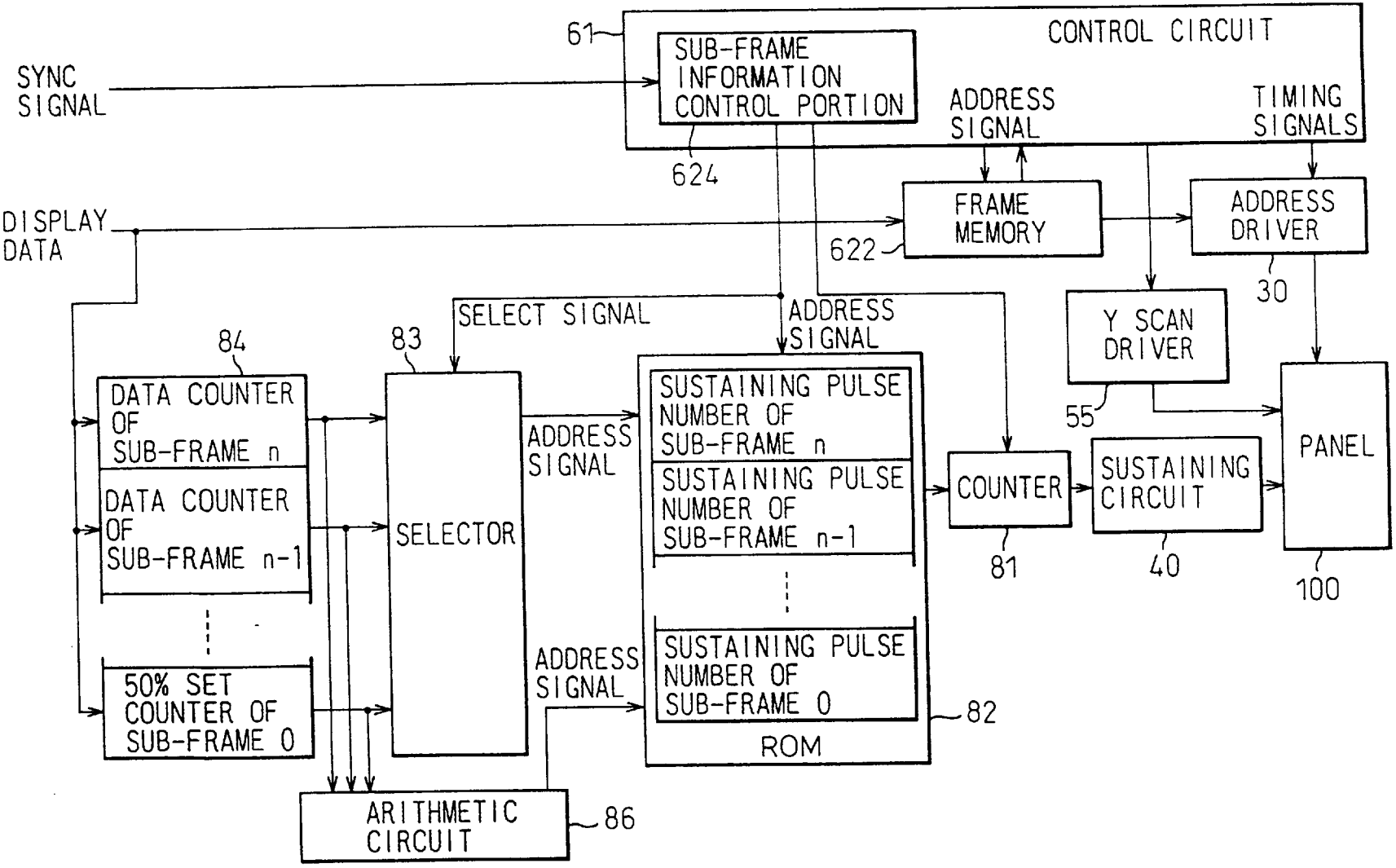
FIG. 32 is a diagram showing the overall configuration of a PDP of the fifth embodiment.
Figure 33:
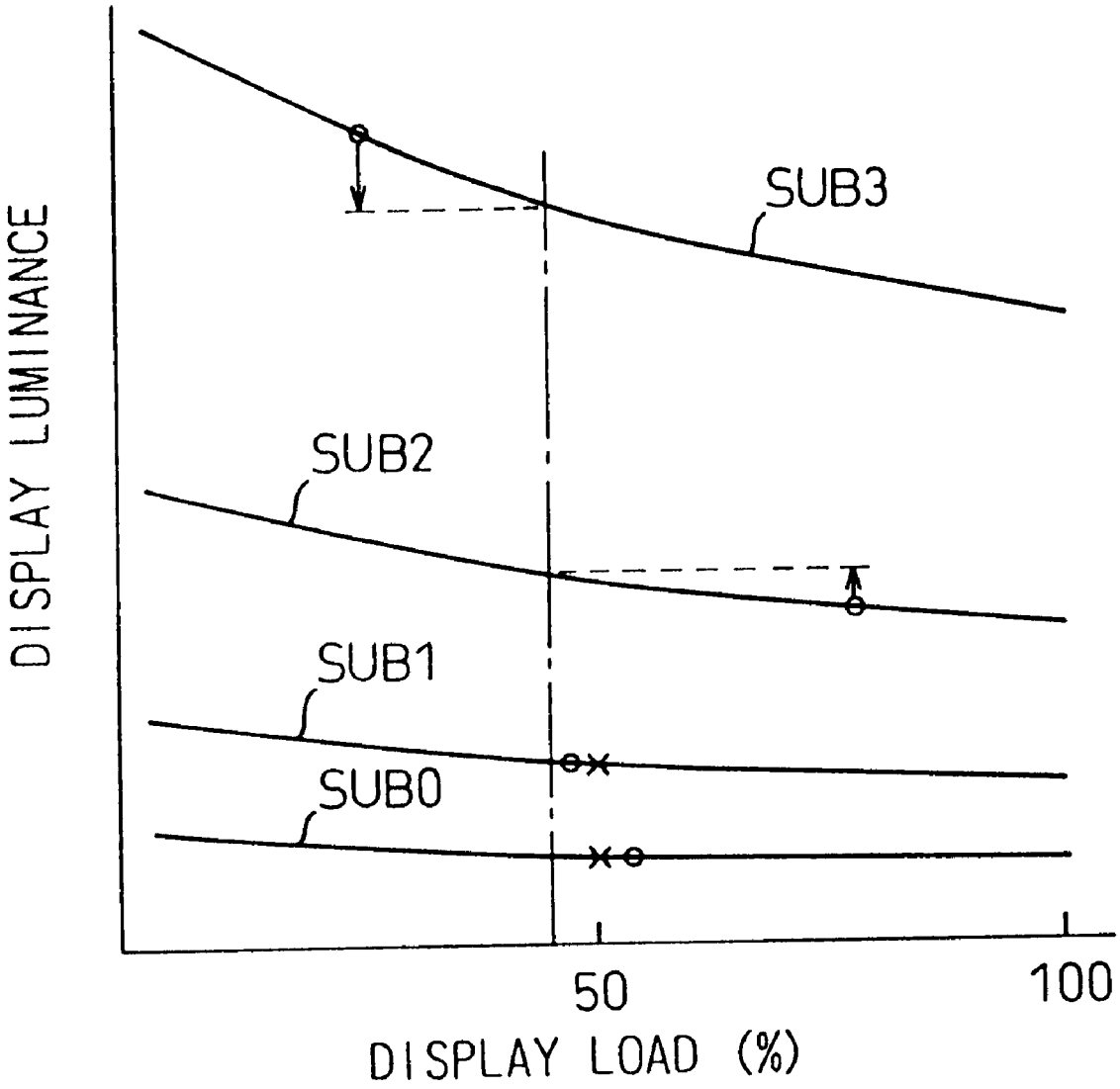
FIG. 33 is a graph for explaining correction in the fifth embodiment.

FIG. 32 shows the configuration of a PDP of the fifth embodiment. FIG. 33 shows a method of correction employed in the fifth embodiment. In FIG. 33, a circle denotes an actual display load. A cross denotes a point indicating a display load of 50% of a full load to be imposed during sub-frame 0 or 1. In this embodiment, a count value is used as a display load to be imposed during a sub-frame which is represented by two high-order bits. For any other sub-frame, a display load is regarded as 50% of a full load. A maximum value, minimum value, weighted mean, median, or the like of display loads to be imposed during sub-frames is then calculated in the same manner as that in the fourth embodiment. Using the calculated value, the corrected number of sustaining pulses is calculated.

As is apparent from a comparison of FIG. 32 with FIG. 29, the differences from the third embodiment are that two of the counters 84 count the numbers of cells enabled to glow during sub-frames represented by two high-order bits, and that a display load to be imposed during any other sub-frame is regarded as 50% of a full load and a signal representing 50% is output. An arithmetic circuit 86 uses count values as display loads to be imposed during sub-frames represented by two high-order bits, and calculates a maximum value, minimum value, weighted mean, median, or the like of display loads to be imposed during sub-frames by regarding a display load to be imposed during any other sub-frame as 50% of a full load. Aside from the two high-order bits, data stored in the ROM 82 should merely include the numbers of sustaining pulses to be applied with display loads of 50% of full loads that can be imposed during other sub-frames.

In the third embodiment, computation is confined to sub-frames represented by two high-order bits. This makes it possible to simplify the circuitry of the counter 84 and that of the arithmetic circuit 85. Influence upon display varies depending on the weight assigned to a sub-frame. Even if computation is confined to sub-frames represented by high-order bits, substantially good display can be accomplished. Display loads to be imposed during sub-frames represented by the high-order bits are affected greatly by overall brightness. Display loads to be imposed during sub-frames represented by low-order bits are statistically about 50% or the like of full loads. For this reason, the influence of the overall brightness poses no problem.

Figure 34:
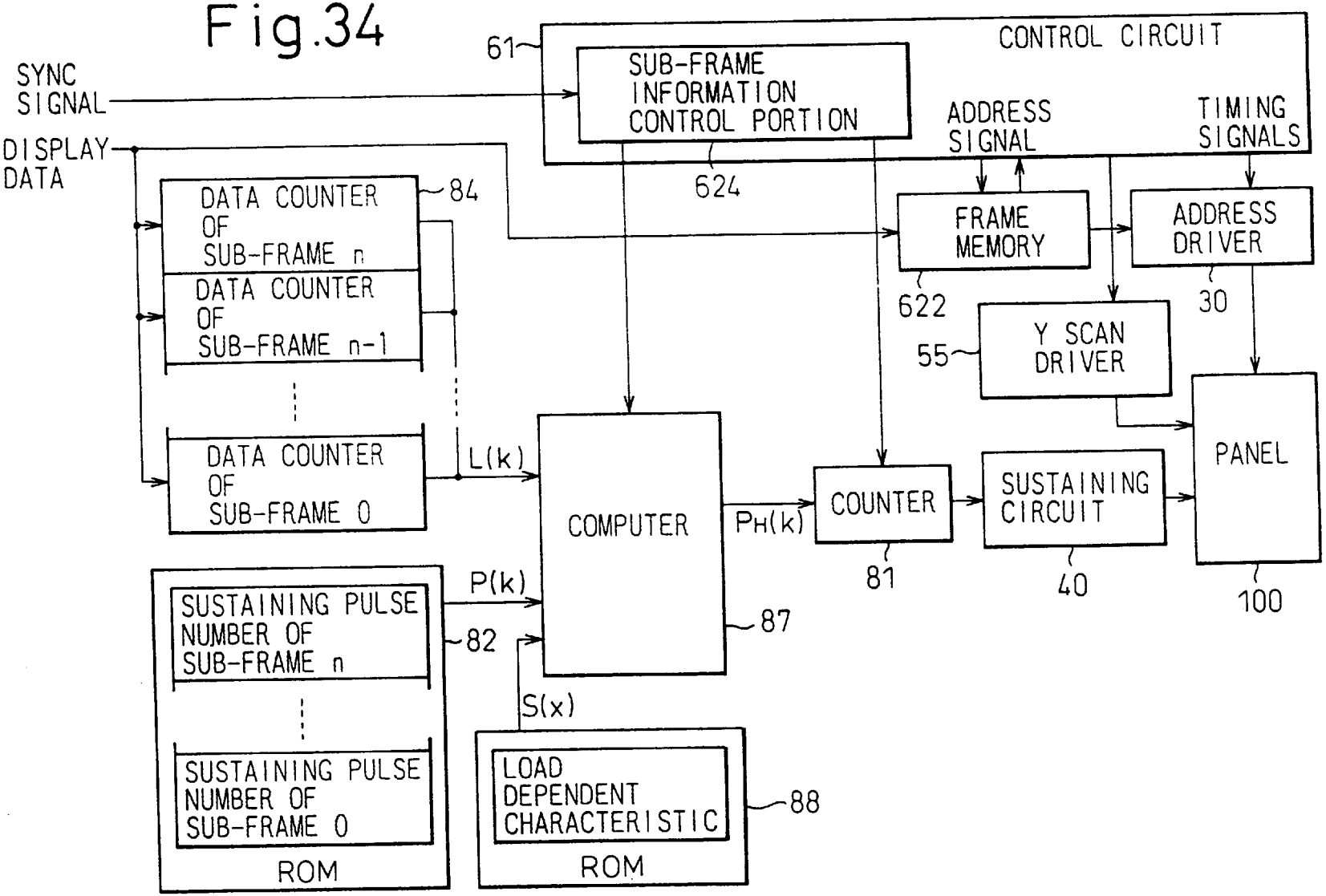
FIG. 34 is a diagram showing the overall configuration of a PDP of the sixth embodiment.
Figure 35:
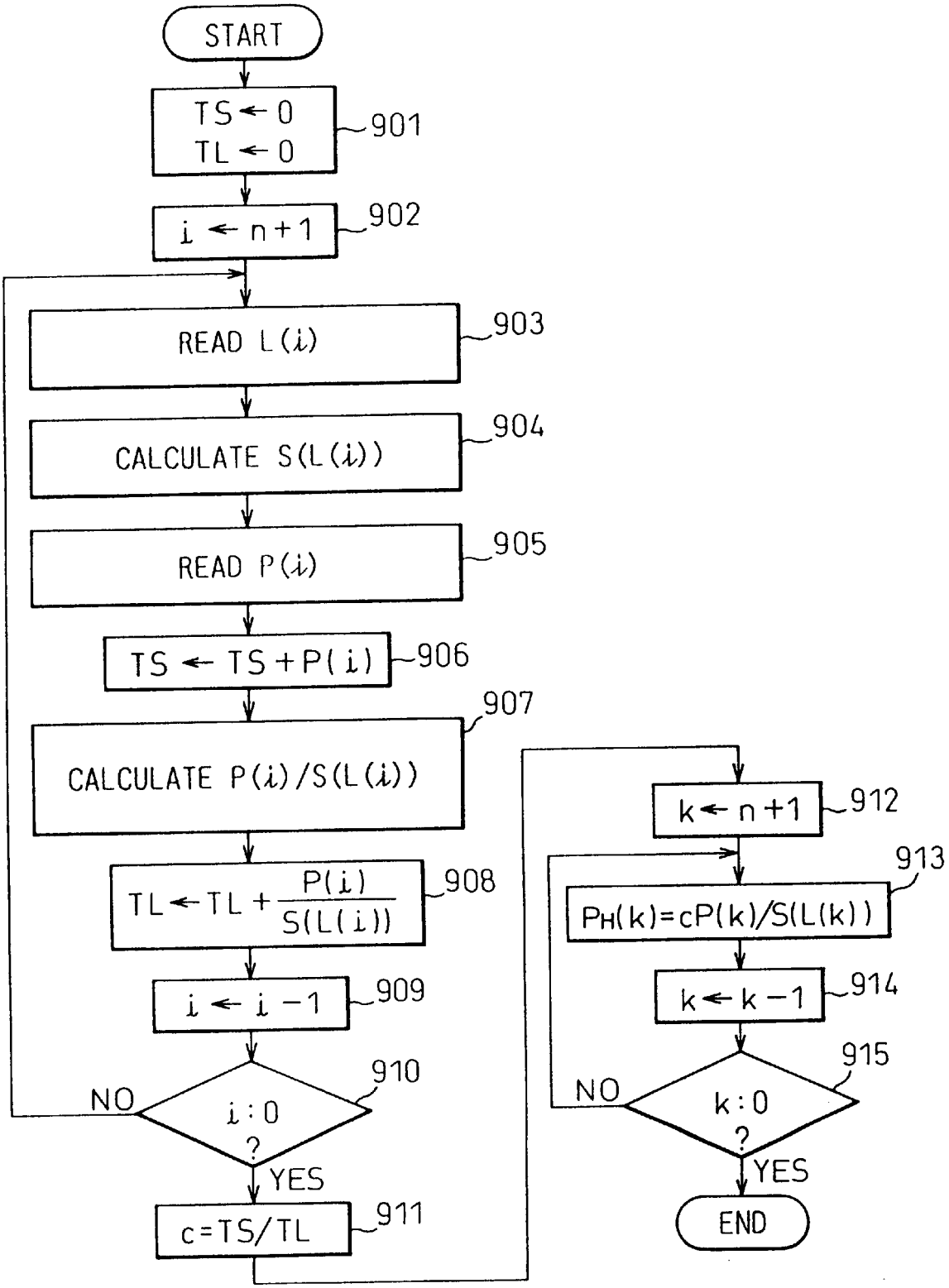
FIG. 35 is a flowchart describing computation in the sixth embodiment.

In the third to fifth embodiments, an arithmetic circuit is used to compute the corrected number of sustaining pulses but a computer may be used instead. FIG. 34 shows the configuration of the sixth embodiment in which a computer is used to compute the corrected number of sustaining pulses. FIG. 35 is a flowchart describing the computation employed in the sixth embodiment. Herein, a brightness is matched with the one permitted by a display load of a weighted mean.

As shown in FIG. 34, a microcomputer 87 and a ROM 88 in which curves showing a characteristic dependent on a display load in FIG. 28 are stored are included. The counters 84 are identical to those shown in FIG. 25. The ROM 82 stores the data shown in FIG. 21.

To begin with, computation in the sixth embodiment will be described using expressions.

Assume that the original number of sustaining pulses to be applied during a k-th sub-frame is P(k), a display load to be imposed during the k-th sub-frame is L(k), and a relative luminance attained when a display load of 100% of a full load is 1 is dependent on a display load and expressed as S(L(k)). Assuming that correction is made relative to a brightness S(M) attained when cells are enabled to glow with a display load M imposed during the k-th sub-frame, when the corrected number of sustaining pulses is $P_H(k)$. $P_H(k)$ is provided as the following expression (1):

$$P_H(k)=S(M)*P(k)/S(L(k)) \quad (1)$$

Since a total sum of the numbers of sustaining pulses to be applied during sub-frames should not be varied between before and after correction, the following expression (2) is established:

$$\Sigma P_H(k)=\Sigma P(k) \quad (2)$$

When the expression (1) is assigned to the expression (2), the following expression (3) is established:

$$\Sigma P(k)=\Sigma S(M)*P(k)/S(L(k))$$
$$=S(M)\Sigma P(k)/S(L(k)) \quad (3)$$

Consequently, the corrected brightness S(M) is given by the expression (4).

$$S(M)=\Sigma P(k)/(\Sigma P(k)/S(L(k)) \quad (4)$$

Herein, ΣP(k) and ΣP(k)/S(L(k)) in the expression (4) can be calculated using the numbers of sustaining pulses to be applied during all sub-frames and brightnesses attained during them.

By assigning the expression (4) to the expression (1), the expression (5) for calculating the corrected number of sustaining pulses $P_H(k)$ is provided.

$$\Sigma P_H(k)=(P(k)/S(L(k))*(\Sigma P(k))/(\Sigma P(k)/S(L(k))$$
$$=(P(k)/S(L(k))*(TS/(\Sigma P(k)/S(L(k)) \quad (5)$$

Next, the computation in the fourth embodiment for calculating the corrected number of sustaining pulses $P_H(k)$ according to the above expression will be described in conjunction with the flowchart of FIG. 35.

At step 501, 0 is set in registers TS and TL. At step 502, the number of sub-frames, n+1, is set in a register i.

At step 503, an output L(i) of an i-th counter 84 associated with an i-th sub-frame is read out. At step 504, S(L(i)) is calculated and placed in memory. At step 505, the original number of sustaining pulses P(i) to be applied during the i-th sub-frame is read from the ROM 82 and placed in memory. At step 506, the P(i) value is added to the value in the register TS and then stored in the register TS again. At step 507, P(i)/S(L(i)) is calculated. At step 508, the solution and the value in the register TL are added up and then stored in the register TL again. At step 509, the value in the register i is decremented by one. At step 510, it is judged whether or not the value in the register i is zero. If the value is not zero, control is returned to step 503. The processing from step 503 to 510 is then executed relative to an n+t-th sub-frame. Consequently, the solutions of ΣP(k) and ΣP(k)/S(L(k)) are placed in the registers TS and TL.

At step 511, TS/TL is calculated and regarded as a computed value C. This value corresponds to the corrected brightness S(M). At step 512, n+1 is set in a register k. At steps 513 to 515, operations are performed successively in order to calculate the corrected number of sustaining pulses $P_H(k)$ to be applied to each sub-frame.

As described so far, according to the second mode of the present invention, a brightness ratio between sub-frames is held constant irrespective of a display load to be imposed on each sub-frame. Consequently, a gray scale is rendered precisely and gray-scale inversion will not occur.

What is claimed is:

1. A panel display comprising:

a display panel including a plurality of cells to be selectively discharged to glow an address driver for setting said plurality of cells to states represented by display data, a display glowing driver for enabling said plurality of cells to glow according to said set states, one frame during which one screen is displayed, said frame having a plurality of sub-frames and glowing periods within said sub-frames, during which said display cells are enabled to glow by said display glowing driver, said sub-frames being weighted in order to achieve gray-scale display a display load for each sub-frame calculating circuit for calculating a display load to be imposed on a whole display surface during each sub-frame; and a corrected period calculating circuit for calculating a corrected period of a glowing period, during which said display cells are enabled to glow by said display glowing driver, according to display load to be imposed during each sub-frame, which is calculated by said display load calculating circuit, so that brightness attained by said display cells during respective sub-frames will be maintained at a given ratio.

2. A panel display according to claim 1, wherein said corrected period calculating circuit calculates a corrected period of a glowing period within each sub-frame, during which said display cells are enabled to glow by said display glowing driver, so that a brightness to be attained will be matched with the one permitted by a display load having a maximum value within a variation range.

3. A panel display according to claim 1, wherein said corrected period calculating circuit calculates a corrected period of a glowing period, during which said display cells are enabled to glow by said display glowing driver, so that a brightness to be attained will be matched with the one attained with imposition of the same display load as the one to be imposed during a sub-frame to which the largest display load is allotted.

4. A panel display according to claim 1, wherein said corrected period calculating circuit calculates a weighted mean of display loads to be imposed during sub-frames in consideration of said weighting, and calculates a corrected period of a glowing period, during which said display cells are enabled to glow by said display glowing driver, so that a brightness to be attained will be matched with the one attained with imposition of a display load of said weighted mean.

5. A panel display according to claim 4, wherein: said corrected period calculating circuit includes a judging circuit for judging if a total sum of calculated corrected periods of glowing periods, during which said display cells are enabled to glow by said display glowing driver, exceeds a given length; and when said total sum exceeds said given length, correction is made so that said total sum will equal to said given length.

6. A panel display according to claim 1, wherein said corrected period calculating circuit calculates a median of display loads to be imposed during sub-frames, and calculates a corrected period of a glowing period, during which said display cells are enabled to glow by said display glowing driver, so that a brightness to be attained will be matched with the one attained with imposition of a display load of said median.

7. A panel display according to claim 1, wherein: said display load calculating circuit calculates display loads to be imposed during sub-frames associated with large weights and represented by high-order bits; and said corrected period calculating circuit calculates a corrected period on the assumption that a given display load is imposed during any sub-frame other than said sub-frames associated with large weights and represented by high-order bits.

8. A driving method for a display panel having a plurality of cells to be selectively discharged to glow, and a frame during which one screen is displayed and is composed of a plurality of sub-frames, each sub-frame including an addressing period during which said plurality of cells are set to states represented by display data, and a display glowing period during which said plurality of cells are enabled to glow according to said set states, said display glowing periods each being weighted in order to achieve gray-scale display, said driving method comprising:

a display load for each sub-frame calculating step of calculating a display load to be imposed on a whole display surface each sub-frame; and a corrected period calculating step of calculating a corrected period of said display glowing period within each sub-frame according to a display load to be imposed on each sub-frame, which is calculated at said display load calculating step, so that brightness attained by display cells during sub-frames will be maintained at a given ratio.

9. A driving method for a display panel according to claim 8, wherein at said corrected period calculating step, a corrected period of said display glowing period within each sub-frame is calculated so that a brightness to be attained will be matched with the one permitted by a display load having a maximum value within a variation range.

10. A driving method for a display panel according to claim 8, wherein at said corrected period calculating step, a corrected period of said display glowing period is calculated so that a brightness to be attained will be matched with the one attained with imposition of the same display load as the one to be imposed during a sub-frame to which the largest display load is allotted.

11. A driving method for a display panel according to claim 8, wherein at said corrected period calculating step, a weighted means of display loads to be imposed during sub-frames is calculated in consideration of said weighting, and a corrected period of said display glowing period is calculated so that a brightness to be attained will be matched with the one attained with imposition of a display load of said weighted mean.

12. A driving method for a display panel according to claim 11, wherein said corrected period calculating step further includes a step of judging if a total sum of calculated corrected periods of display glowing periods exceeds a given length, and when said total sum exceeds said given length, correction is made so that said total sum will equal to said given length.

13. A driving method for a display panel according to claim 8, wherein at said corrected period calculating step, a median of display loads to be imposed during sub-frames is calculated, and a corrected period of said display glowing period is calculated so that a brightness to be attained will be matched with the one attained with imposition of a display load of said median.

14. A driving method for a display panel according to claim 8, wherein display loads to be imposed during sub-frames associated with large weights and represented by high-order bits are calculated at said display load calculating step, and a corrected period is calculated by said corrected period calculating means on the assumption that a given display load is imposed during any sub-frame other than said sub-frames associated with large weights and represented by high-order bits.

* * * * *

UNITED STATES PATENT AND TRADEMARK OFFICE

CERTIFICATE OF CORRECTION

PATENT NO. : 6,104,362
DATED : August 15, 2000
INVENTOR(S) : Kuriyama et al.

It is certified that error appears in the above-identified patent and that said Letters Patent is hereby corrected as shown below:

Column 29,
Line 7, please delete "for each sub-frame".
Line 8, after "a display load", please insert -- for each sub-frame --.

Column 30,
Line 9, please delete "for each sub-frame".
Line 10, after "a display load", please insert -- for each sub-frame --.

Signed and Sealed this

Ninth Day of October, 2001

*Attest:*

Nicholas P. Godici

*Attesting Officer*

NICHOLAS P. GODICI
*Acting Director of the United States Patent and Trademark Office*